US006243930B1

(12) United States Patent
Orzel

(10) Patent No.: US 6,243,930 B1
(45) **Date of Patent: *Jun. 12, 2001**

(54) SPREADER FOR CALENDER LINE

(75) Inventor: Edward S. Orzel, North Royalton, OH (US)

(73) Assignee: North American Manufacturing Company, Cleveland, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/684,639

(22) Filed: Oct. 10, 2000

Related U.S. Application Data

(63) Continuation of application No. 09/545,102, filed on Apr. 6, 2000, now Pat. No. 6,182,339, which is a continuation-in-part of application No. 09/507,724, filed on Feb. 22, 2000, now Pat. No. 6,185,800, which is a continuation of application No. 09/114,374, filed on Jul. 14, 1998, now Pat. No. 6,029,325, which is a continuation of application No. 08/938,567, filed on Sep. 26, 1997, now Pat. No. 5,781,973.

(51) Int. Cl.[7] ..... D06C 3/06
(52) U.S. Cl. ..... 26/97; 26/74
(58) Field of Search ..... 26/71, 74, 75, 26/97, 99, 105, 51, 51.3, 51.4, 88, 103; 28/212, 282, 248, 268; 226/17, 23, 190

(56) References Cited

U.S. PATENT DOCUMENTS

| | | |
|---|---|---|
| 1,376,736 | 5/1921 | Thornber . |
| 1,563,704 | 12/1925 | Greis . |
| 2,639,483 | 5/1953 | Wester . |
| 2,665,470 | 1/1954 | Stapleton . |
| 2,709,475 | 5/1955 | Steckel et al. . |
| 2,806,694 | 9/1957 | Penman . |
| 3,462,053 | 8/1969 | Behr . |
| 3,637,121 | 1/1972 | Alexeff . |
| 3,752,377 | 8/1973 | Knapp . |
| 4,007,865 | 2/1977 | Crandall . |
| 4,301,579 | 11/1981 | Van Den Hoven . |
| 4,554,714 | 11/1985 | Cho . |
| 4,706,349 | 11/1987 | Gallant . |
| 4,920,622 | 5/1990 | Mair et al. . |
| 5,619,779 | 4/1997 | Geyer . |

*Primary Examiner*—Amy B. Vanatta
(74) *Attorney, Agent, or Firm*—Vickers Daniels & Young

(57) ABSTRACT

A spreader for spreading a fabric having upper and lower sides, transversely spaced edges and longitudinally extending reenforcing cords spaced laterally across said fabric between said edges preparatory to treating the fabric in a calender, as the fabric moves in a given path to the calender. The spreader includes a mandrel having an outer generally cylindrical surface concentric with a rotational axis. The cylindrical surface has a helical groove having convolutions with a pitch generally equal to a desired cord distribution laterally of the fabric. The mandrel is rotatably mounted to a support structure such that the mandrel is positioned transverse to the fabric with the cylindrical surface of the mandrel aligned with the fabric path to be generally tangential to a side of the fabric as the fabric moves in the given path. A first motor positioned on the support structure rotates the mandrel about the axis at a given rotational speed. A second motor moves the support structure in a direction parallel to the rotational axis of the mandrel and at a given linear speed as the first motor is rotating the mandrel until a number of cords of the fabric at the one edge of the fabric are captured in the helical groove and spaced by the pitch of convolutions of the groove at a desired cord distribution. A density detector measures the density of the cords as the cords are captured or prior thereto. The measured cord density is used to adjust the rotation speed of the mandrel and/or the linear speed of the support structure to obtain one cord per groove in the mandrel.

23 Claims, 15 Drawing Sheets

SPREADER FOR CALENDER LINE

This patent application is a continuation of application Ser. No. 09/545,102 filed on Apr. 6, 2000, now U.S. Pat. No. 6,182,339 and incorporated herein by reference, which is a continuation-in-part of U.S. patent application Ser. No. 09/507,724 filed Feb. 22, 2000, now U.S. Pat. No. 6,185,800 which in turn is a continuation of U.S. patent application Ser. No. 09/114,374, filed Jul. 14, 1998 now U.S. Pat. No. 6,029,325 issued February 29, 2000 entitled "Spreader for Calender Line" which in turn is a continuation of U.S. patent application Ser. No. 08/938,567, filed Sep. 26, 1997, now U.S. Pat. No. 5,781,973 issued July 21, 1998 entitled "Spreader for Calender Line."

The present invention relates to the art of spreading a fabric preparatory to processing the fabric in a calender line and more particularly to a spreader and system using the spreader for controlling the width of a cord containing fabric before entering a calender that rubberizes the fabric to produce sheet material used in the production of tires.

INCORPORATION BY REFERENCE

Incorporated herein by reference herein is Bulletin No. 10191 from North American Manufacturing Company entitled Calendar Lines "Total Concept" dated April 1991. This trade bulletin discloses a well known calender line for producing laminating fabric to be used in the manufacturing of tires. Bulletin No. 10191 also illustrates the environment to which the present invention is directed which is a spreading mechanism located immediately before the calender. Also incorporated herein by reference is U.S. patent application Ser. No. 09/114,374 filed Jul. 14, 1998 titled "Spreader for Calender Line" which discloses an arrangement for a calendar line spreader which can be used in the present invention.

BACKGROUND OF THE INVENTION

In the tire and rubber industry, calender lines process "gray" fabric for the purpose of producing laminate sheets used to construct rubber tires. The fabric includes longitudinally extending reenforcing cords spaced laterally across the fabric between two transverse edges, which cords are held together by transversely extending picks including small strands or threads spaced longitudinally of the fabric. The fabric is unrolled and then treated in the calender line in a manner that requires periodic spreading of the fabric to a width which is carefully controlled as the fabric enters the calender. The tire cord fabric is produced with various cord counts per inch across the fabric, i.e, cord distribution. In some instances, the cord count or distribution is as low as twelve cords per inch; however, it can be as high as thirty cords per inch. These fabric cords are held together by the picks, which are woven perpendicular in the cords and spaced along the fabric with 2–3 picks per linear inch of cord. From a quality standpoint, the objective is to have the desired cord count extending uniformly over the entire width of the fabric before the fabric is introduced into the calender. However this even distribution of the cords is not accomplished in calender lines now in use. The fabric has a tendency to neck down as it travels toward the calender; therefore, the fabric must be respread several times in the calender line. Spreading devices heretofore used are not predicated on the cord count. As the fabric is respread periodically during its travel through the line, a greater number of cords remain bunched at the edges because the spreading devices are ineffective in spreading this portion of the fabric. Thus, a high concentration of cords appear adjacent the edges of the fabric as the fabric enters the calender for rubberization even though the fabric has the proper width. After processing by the calender, the edge portions of the fabric must be removed by a continuous cutting operation that results in a large amount of scrap with a corresponding reduction in yield for the calender line. Typically, the outer three to five inches at the edges of the fabric are unacceptable because of an over concentration of cords. This particular problem has troubled the tire and rubber industry for many years. To date, the industry has not developed an automatic spreading device that controls the count of the cords across the fabric preparatory to the fabric entering the calender.

Static devices, such as spread bars, have been added to the calender line immediately adjacent the entrant end of the calender in an attempt to address the problem of the cords of the fabric grouping at the edge of the fabric. These bars have two to four indexed positions and they must be manually shifted as a different fabric is being processed. Such devices cannot control width, are not automatic and substantially increase labor costs and down time when changing fabric being processed in the calender line. The most common spreader immediately adjacent the calender is a three finger spreader. This device generally spreads to width; however, the cord count across the fabric is not controlled. Feedback arrangements for use on three finger spreaders are difficult to fabric, i.e, cord distribution. In some instances, the cord count or distribution is as low as twelve cords per inch; however, it can be as high as thirty cords per inch. These fabric cords are held together by the picks, which are woven perpendicular in the cords and spaced along the fabric with 2–3 picks per linear inch of cord. From a quality standpoint, the objective is to have the desired cord count extending uniformly over the entire width of the fabric before the fabric is introduced into the calender. However this even distribution of the cords is not accomplished in calender lines now in use. The fabric has a tendency to neck down as it travels toward the calender; therefore, the fabric must be respread several times in the calender line. Spreading devices heretofore used are not predicated on the cord count. As the fabric is respread periodically during its travel through the line, a greater number of cords remain bunched at the edges because the spreading devices are ineffective in spreading this portion of the fabric. Thus, a high concentration of cords appear adjacent the edges of the fabric as the fabric enters the calender for rubberization even though the fabric has the proper width. After processing by the calender, the edge portions of the fabric must be removed by a continuous cutting operation that results in a large amount of scrap with a corresponding reduction in yield for the calender line. Typically, the outer three to five inches at the edges of the fabric are unacceptable because of an over concentration of cords. This particular problem has troubled the tire and rubber industry for many years. To date, the industry has not developed an automatic spreading device that controls the count of the cords across the fabric preparatory to the fabric entering the calender.

Static devices, such as spread bars, have been added to the calender line immediately adjacent the entrant end of the calender in an attempt to address the problem of the cords of the fabric grouping at the edge of the fabric. These bars have two to four indexed positions and they must be manually shifted as a different fabric is being processed. Such devices cannot control width, are not automatic and substantially increase labor costs and down time when changing fabric being processed in the calender line. The most common spreader immediately adjacent the calender is a three finger spreader. This device generally spreads to width; however, the cord count across the fabric is not controlled. Feedback arrangements for use on three finger spreaders are difficult to control and sometimes result in splitting of the fabric.

Bowed roll spreaders are commonly used to spread the fabric to the desired width. Indeed, four or five bowed roll spreaders may be used before the fabric enters the calender. The three finger spreaders are located six to eight feet beyond the last bowed roll spreader since a bowed roll spreader can not be located close to the calender. Consequently, the fabric necks down after the last bowed roll spreader and before it enters the calender itself. For that reason, there is a need for a spreader to control fabric width immediately adjacent the entrant end of the calender. The three finger spreader is the device which is now commercially acceptable. Since a three finger spreader at this location can cause breakage of the picks and/or cords when using a feedback control, a fixed three finger spreader has been used to approximate the desired width of the fabric as it enters the calender. The only way to actually distribute the cord is the previously mentioned spreader bar that can be located immediately before the calender. This device is so labor intensive that it is not widely used. The operator must spread the fabric over the face of the bar before the line can be continuously operated. The calender lay down roll cannot be cleaned without removing the bar; therefore, the operator plays a substantial roll in a line which uses a spreader bar for distributing the cords prior to the calender. Thus, only width control devices have been used routinely in the tire industry for a calender line.

The edge spreader system disclosed in U.S. patent application Ser. No. 09/114,374 filed Jul. 14, 1998 titled "Spreader for Calender Line" overcomes many of the problems of past edge spreaders. The edge spreader system incorporates the use of a mandrel have a surface with a plurality of grooves. The surface of the mandrel has a generally cylindrically shape with grooves formed by a helically shaped groove. The helical groove has convolutions having a pitch generally equal to the desired cord distribution laterally of the fabric. The mandrel is moved laterally toward the fabric and simultaneously rotated to capture the cords in the groove of the mandrel. The mandrel is rotated at a constant speed and moved laterally at a constant speed until the edge of the fabric is positioned in a desired position relative to the calender. An edge sensor and feedback control system are used to control the edge of the fabric relative to the calender. The edge spreading system can include an arrangement to engage two or more mandrels having different pitch grooves with the fabric so that different cord distributions in various fabrics can be easily processed by the edge spreader system.

Although the edge spreading system disclosed in U.S. patent application Ser. No. 09/114,374 is a significant advance and improvement over past edge spreading arrangements, the edge spreading system requires the bunching of the cords at the edge of the fabric prior to capturing the cords on the mandrel. If the cords at the edge of the fabric are not closely bunched together, the mandrel has a tendency to spread these cords farther apart than desired. However, if the cords at the fabric edge are bunched to closely together or overlap one another, the mandrel may not properly spread apart all of the cords at the edge of the fabric. In addition to problems with some cord distributions, the cords traveling in the grooves of the mandrel have a tendency to lift or pop out of the grooves as the fabric moves over the grooves resulting in uneven cord distributions. This lifting of the cords out of the grooves is caused by the picks in the fabric that hold the cords together.

In view of the deficiencies of the edge spreading system disclosed in U.S. patent application Ser. No. 09/114,374, there is a need for an improved edge spreader system that more accurately controls the fabric cord spacing and fabric position prior to the fabric entering a calender, and maintains the desired cord spacing.

SUMMARY OF THE INVENTION

The present invention relates to a system for spreading a fabric before it enters a calender, and more particularly to a system for spreading a cord containing fabric before the fabric enters the calender that is used in making rubberized tire laminating sheet material. In addition, the invention relates to a spreader for use immediately adjacent the entrant end of the calender and a grooved mandrel used in this novel spreader. The fabric which is introduced into the calender has an upper and lower side, transversely spaced, parallel first and second edges and longitudinally extending cords spaced laterally across the fabric between the edges. The edge spreading system, according to the present invention, spreads this type of fabric preparatory to processing the fabric, such as, but not limited to, rubberizing the fabric, in a calender as the fabric moves in a given path through a calender line to the calender. The edge spreading system controls the position of the edges of the fabric to be positioned in a desired transverse location thereby determining the desired width of the fabric entering the calender, while still maintaining an even distribution of cords across the fabric.

Prior spreading devices were ineffective in spreading the bunched cords at the edges of the fabric thus causing the edges to be scrap. The edge spreading system of the present invention includes at least one edge spreader mounted at least one side of the fabric at the entrant end of the calender. The edge spreader includes a mandrel directed toward the center of the fabric. In one embodiment, a pair of edge spreaders are mounted on opposite sides of the fabric. In another embodiment, the mandrel is a cantilever mounted mandrel. In still another embodiment, the mandrel is mounted so the outer surface of the mandrel is generally tangential to a surface of the fabric. In one specific aspect of this embodiment, the outer surface of the mandrel is generally tangential with the lower surface of the fabric. In still another embodiment, at least a portion of the mandrel surface is arcuate. In one specific aspect of this embodiment, at least a portion of the mandrel surface is cylindrically shaped and concentric with a rotational axis. In yet another embodiment, at least a portion of the surface of the mandrel includes spaced grooves. In one specific aspect of this embodiment, the grooves are adapted to receive one or more cords of the fabric as the fabric at partially passed over the surface of the mandrel. In another specific aspect of this embodiment, the grooves in the surface of the mandrel are spaced apart a distance that is generally equal to the desired cord distribution laterally of the fabric. In still another specific aspect of this embodiment, the surface of the mandrel is a generally cylindrical surface and the grooves in the cylindrical surface of the mandrel are formed from a helical groove with convolutions having a pitch generally equal to the desired cord distribution laterally of the fabric. In still yet another aspect of this embodiment, at least one groove is sized to hold a single cord of the fabric. In still yet another embodiment, the spreader includes a mechanism to move the mandrel into contact with the fabric. In one specific aspect of this embodiment, the mandrel is moved laterally and/or vertically to engage the mandrel with the fabric. In another specific aspect of this embodiment, the spreader includes a mechanism to engage the grooves in the surface of the mandrel with one or more cords in the fabric. In yet another specific aspect of this embodiment, the mandrel is moved in a lateral direction to engage the surface of the mandrel with the fabric. In still yet another specific aspect of this embodiment, the mandrel is moved upwardly and/or downwardly to engage the surface of the mandrel with the fabric. In a further specific aspect of this embodiment, the mandrel is moved in a lateral and vertical direction to engage the surface of the mandrel with the fabric. In still a further specific aspect of this embodiment, the mandrel is first moved laterally and then vertically to engage the surface of the mandrel with the fabric. In yet a further specific aspect of this embodiment, the mandrel is first moved vertically and then laterally to engage the surface of the mandrel with the fabric. In still yet a further specific aspect of this embodiment, the mandrel is simultaneously moved laterally and then vertically to engage the surface of the mandrel with the fabric.

In accordance with another aspect of the present invention, the spreader includes a mechanism to capture the cords of the fabric in a plurality of grooves on the mandrel. In one embodiment, the spreader includes a mechanism to rotate the mandrel to pull the cords onto the mandrel in the helical groove and/or move the mandrel laterally toward the fabric to cause the cords to move into the grooves on the surface of the mandrel. In another embodiment, the rotation of the mandrel is stopped when the edge of the fabric moving along the groove of the mandrel reaches a desired position on the mandrel. In one specific aspect of this embodiment, the desired position of the fabric on the mandrel is determined by a sensor. The sensor can be a light sensor, a contact sensor or the like. The sensor can be mounted on the mandrel or be positioned at some location spaced from the mandrel. In yet another embodiment, the mandrel is moved laterally toward the fabric to cause the surface of the mandrel to move laterally under the fabric until the fabric is moved to a desired location on the surface of the mandrel. In one specific aspect of this embodiment, the desired position of the fabric on the mandrel is determined by a sensor. In still another embodiment, the surface of the mandrel is rotated simultaneously with the mandrel being moved laterally toward the fabric. In still yet another embodiment, the rotational speed of the mandrel is at a first rotational speed which effectively advances the groove outwardly one pitch in a selected time while the speed of the mandrel in the lateral direction is advancing the mandrel inwardly at a rate that is less than one pitch in the selected time whereby the rotation and lateral or linear motion pulls the cords outwardly by the rotating groove. These two rates are relational in concept so that the mandrel is rotating and pulling the cords of the fabric at a rate faster than the mandrel is moving toward the fabric in the lateral direction. By accomplishing this relationship of the rotational speed and the speed in the lateral direction, the cords are pulled by the rotating mandrel in a manner to spread the fabric until the edge of the fabric is at a given position on the mandrel. In one specific aspect of this embodiment, once the fabric reaches the desired position on the mandrel, the mandrel ceases rotating. In another specific aspect of this embodiment, the width of the fabric is controlled by the rotation of the mandrel and/or the lateral movement of the mandrel carrying the captured cords. In yet another specific aspect of this embodiment, the ratio of rotation of the mandrel relative to the lateral movement of the mandrel is greater than 1:1 so that the actual transverse position of the edge of the fabric will change relative to the calender. In practice, the ratio is about 1:0.6–0.9, and preferably about 1:2/3. This concept is novel and has substantial advantages; however, by changing the ratio of linear movement to rotational movement, the cord is pulled outwardly and the fabric is spread during the capturing action of the rotating mandrel. This pulling action during the initial capture mode has a distinct advantage. The cords in front of the advancing mandrel do not bunch. Any slight bunching action in front of the advancing mandrel is distributed by pulling the mandrel outwardly after capturing the edge cords. In still yet another embodiment, the rotating grooved mandrel first captures the edge of the fabric by the combined rotational and lateral movement of the mandrel until the fabric is on the mandrel about 2–5 inches. Thereafter, movement of the mandrel is used for width control preparatory to the fabric being introduced into the calender. In a further embodiment, the mandrel, after capturing the cords of the fabric in the mandrel grooves, is moved laterally into a desired position relative to the calender until the support structure for the mandrel is at the desired location for the edge of the fabric relative to the calender. In one specific aspect of this embodiment, the mandrel is rotated until the edge of the fabric is at a desired position on the mandrel and the support structure of the mandrel is then moved laterally until the mandrel is positioned in a desired location relative to the calender so that the edge of the fabric is also positioned in a desired location relative to the calender.

In yet another aspect of the present invention, a feedback control arrangement is used to control the position of the fabric on the mandrel. In one embodiment, a feedback control system using an error amplifier senses the position of the edge of the fabric and moves the mandrel to maintain the edge at a location to control the position and/or width of the fabric. In one specific aspect of this embodiment, the position of the edge of the fabric is moved on the mandrel by rotating the surface of the mandrel in a clockwise and/or counterclockwise direction. In another specific aspect of this embodiment, the mandrel is moved laterally relative to the position of the fabric to move the fabric on the mandrel. In still another specific aspect of this embodiment, the mandrel is rotated clockwise and/or counterclockwise and moved laterally relative to the position of the fabric to move the fabric on the mandrel.

In still yet another aspect of the present invention, at least one mandrel is retracted from the fabric prior to starting a new fabric into the calender. In one embodiment, all mandrels are retracted from the fabric prior to starting a new fabric. The ability to retract one or more mandrels from the fabric is an advantage over the prior art spreader bars which had to be manually indexed between each fabric being run by the calender line.

In a further aspect of the present invention, the spreading system includes a bowed spreader position approximately 6–8 feet before the edge spreaders , the bowed spreaders are used to preset the width of the fabric to be less than the desired final width of the fabric passing through the calender. In this manner, the fabric, as it is being first introduced into the calender line, approaches the edge spreaders at a slightly narrowed width than the desired width to be passed through the calender. In one embodiment, the position of the fabric edges after passing through the bowed spreader are about one to two inches inward of the desired or final positions of the fabric. The reduced width of the incoming fabric allows the rotating grooved mandrels of the novel edge spreaders to move inwardly to a desired position determined by the fabric width being processed and then rotated and moved laterally to capture the cords of fabric and pull the cords outwardly. In another embodiment, the fabric is spread until the edge is detected by a edge sensor that is mounted adjacent the rotating mandrel on the mandrel support structure. In one specific aspect of this embodiment, when this edge is detected to be in the desired position on the mandrel, the rotation of the mandrel is stopped, and the lateral movement mechanism of the mandrel is then activated to pull the fabric to the final desired position. In still another embodiment, the edge of the fabric, as detected by a sensor on the mandrel support structure, is maintained at a desired position on the mandrel by a standard feedback arrangement including an error amplifier that creates an error signal determined by the position of the edge of the fabric during the calendering operation.

In accordance with another aspect of the present invention, the spreading system employs two or more mandrels to facilitate in fabric change over. In one embodiment, a rotating turret or other indexing mechanism carries a second mandrel so a mandrel having a different groove spacing is on stand-by. As the fabric has been run through the calender line and a next fabric is to be processed, the edge spreader in use is moved away from the fabric such as by moving the mandrel upwardly, downwardly and/or laterally from the fabric. The turret is indexed to position a new mandrel for the next fabric. Thereafter, the fabric capturing mode is repeated for the second fabric spliced to the tail end of the existing fabric. In another embodiment, the first mandrel is removed and replaced by still a third mandrel or the first used mandrel may remain on the turret and be the stand-by mandrel if the first fabric is to be processed next. In still another embodiment, to assist the rapid conversion of the novel edge spreaders to a different mandrel, the mandrel is provided with a quick disconnect arrangement.

In accordance with still another aspect of the present invention, the edge spreader is located closely adjacent the calender and functions in concert with a full width spreader that is upstream. In one embodiment, two edge detectors, one edge spreader on each opposite side of the fabric, are controlled to position the edges of the fabric for maintaining the desired width and position of the fabric entering the calender. In one specific aspect of this embodiment, the two edge spreaders are independently controlled. In another embodiment, the grooved mandrel is approximately eight inches long and is cantilevered mounted from a motorized housing and/or support structure. In one specific aspect of this embodiment, the housing or support structure is mounted to a frame fixed to the side of the calender frame to allow approximately twenty-four inches of linear travel of the mandrel support housing or support structure. In another specific aspect of this embodiment, a standard H3111 detector by North American Manufacturing is used to detect the edge of the fabric and is fixed to the mandrel support structure. In still another specific aspect of this embodiment, a linear or axial transducer is employed for determining the linear or lateral position of the mandrel support structure on the fixed frame. This transducer is preferably a standard axial position transducer that allows the mandrel support structure to be moved to a home position for a given fabric before the capturing cycle is initiated. Then this transducer is used to move the mandrel support structure so its edge sensor (H3111) is at the desired edge position for width control as the fabric is in a normal run. In still a further specific aspect of this embodiment, a drive motor rotates the mandrel and a second motor positions the mandrel support structure on the fixed frame to move the support structure to the home position, shift to capture mode to capture the cords on the mandrel, and then shift to the width control mode using standard edge control, feedback technology, in a desired sequence.

In still yet another aspect of the present invention, the mandrel has a helical groove with a pitch that is close to the ideal cord spacing or distribution for the fabric being captured and width controlled. In one embodiment, the mandrel grooves are more coarsely spaced than the ideal cord spacing for the fabric being processed. In another embodiment, the mandrel grooves are polished and are preferably hardened to protect against wear. In another embodiment, the depth of the groove on the mandrel is approximately the diameter of the reenforcing cords. In still another embodiment, the depth of the groove on the mandrel is less than the diameter of the reenforcing cords.

In accordance with a further aspect of the present invention, a full width spreader spreads a fabric to a width is slightly less than the ultimate desired width for the fabric being processed. When this slightly less width fabric reaches the edge spreading system, a command signal is generated to trigger operation of the edge spreaders. A motor engages and drives the grooved mandrel causing it to rotate. At the same time, another motor causes the mandrel to move laterally or linearly toward the center of the fabric. The rotating mandrel is advanced toward the edge of the fabric in a position whereby the plane of the fabric is approximately tangential to the root diameter of the grooves on the rotating grooved mandrel. The rate of lateral or linear movement of the mandrel is coordinated with the rate of the rotational speed of the mandrel. In one embodiment, the rate of lateral movement of the mandrel to the rate of the rotational speed of the mandrel is proportional. The mandrel advances into the fabric at a rate which is consistent with the pitch of the rotating mandrel. In practice, the rate of the lateral movement of the mandrel is slightly reduced compared to the rotational rate of movement of the mandrel. In this manner, the fabric is spread as it is pulled by the rotating groove, which groove is rotating proportionally faster than the advancing speed of the mandrel. The rotational speed of the mandrel pulls the cord outwardly at a linear speed. This linear speed is greater than the inward lateral movement speed of the mandrel caused by a second motor. These two speeds are coordinated to prevent excessive lateral forces on the fabric that could cause the cords to jump from the grooves as they are being pulled outwardly by rotation of the mandrel. The advancement of the mandrel into the fabric continues until the outermost fabric edge is sensed by an edge sensor or detector. In another embodiment, the sensor is located so that about two to five inches of fabric are threaded on the mandrel before the edge of the fabric is detected by the sensor. In yet another embodiment, when the rotation of the mandrel is stopped upon the edge of the fabric being detected by the sensor, the mandrel is moved laterally outwardly toward the side frame of the calender. This causes a spreading of the fabric while maintaining the cords separated at the edge portion as established by the grooves in the mandrel. In one specific aspect of this embodiment, an axial transducer is employed to determine when the mandrel assembly has reached a position that is consistent with the sensor on the mandrel support structure being the target width of the fabric. At that time, the mandrel support structure is parked in position. Control then reverts to the edge sensor mounted on the mandrel support structure. In still another embodiment, should the fabric jump out of the grooves, the sensor will cause the mandrel to rotate thereby screwing the fabric back into the proper position. In still yet another embodiment, should the fabric become overspread, the mandrel will rotate in the opposite direction thereby unscrewing the fabric to a smaller width. In a further embodiment, the position of the fabric edge is controlled by moving the mandrel support structure back and forth. In yet a further embodiment, the mandrel is rotated back and forth to control the edge position and the linear mandrel support structure is moved back and forth to control the edge position. In still a further embodiment, the width control of the fabric is controlled after the cord has been captured and detected to be at a desired position on the mandrel. The spreader then operates merely to control the edge position on both sides of the fabric to the desired position for width control.

In accordance with another aspect of the present invention, the edge spreader system includes a mechanism to detect the density of the cords in the fabric. As the fabric moves toward the edge spreader system, the cords in the fabric are distributed in various densities along the width of the fabric. Typically, the fabric has a higher cord density at or near the edge of the fabric. This higher cord density is typically caused by the bunching of the fabric cords at the fabric edges as the fabric is directed toward the calender. As the fabric passes through a bow spreader, the bow spreader causes the fabric edges to move inwardly about one to two inches of the desired width of the fabric. Irrespective of how the cords at the edge of the fabric become bunched, the reduction in fabric width results in the cords at and near the edges of the fabric to group closer together thereby forming a high cord density at and near the edge of the fabric. Although the cord density is greater at and near the edges of the fabric, the cord density is not necessarily uniform from the edge of the fabric inward. The edge spreading system disclosed in U.S. patent application Ser. No. 09/114,374 filed Jul. 14, 1998 and Ser. No. 08/938,567 filed Sep. 26, 1997 utilize a rotating mandrel having a helical groove to space the fabric cords in a desired and uniform manner. However, the rotation speed of the mandrel is maintained at a generally constant speed during the capture of the cords. As a result, the cord distribution at the edges of the fabric need to be generally uniform for the rotating mandrel to obtain the desired spacing of all the cords on the edge of the fabric. When the cord density is greater than anticipated, two or more cords will be captured by a groove in the mandrel and/or one or more cords will be positioned between two grooves in the mandrel. When the cord density is less than anticipated, one or more grooves in the mandrel will not capture a cord. In each of these situations, the desired cord distribution at the edge of the fabric is not achieved by rotating the mandrel at a generally constant speed. The monitoring and/or detection of the cord density at the edge of the fabric is used to overcome this problem. Based upon the detected cord density, the rotation speed of the mandrel and/or the lateral speed of the mandrel is adjusted so that each groove in the mandrel captures a cord so that no cords are positioned between two grooves and/or more than one cord is positioned in a groove. As a result, the desired cord distribution at the edge of the fabric is achieved prior to the fabric entering the calender.

In accordance with still another aspect of the present invention, the speed at which the mandrel rotates when capturing the cords is a function of the density of cords detected by the density sensor. The speed of rotation of the mandrel increases or remains the same when a large cord density is detected. The speed of rotation of the mandrel decreases or remains the same when a small cord density is detected. In one embodiment, the speed of the rotation of the mandrel is proportional of the cord density detected by the density sensor. In another embodiment, the speed of rotation of the mandrel is at least partially controlled by a feedback control loop. In one specific aspect of this embodiment, the current rotation speed of the mandrel is measured and/or sensed and this actual speed is compared to a signal produced from the density sensor which signal is a function of the density of the fabric cords. The compared signals then produce a signal to cause the rotation speed of the mandrel to increase, decrease or remain the same. In yet another embodiment, the speed of rotation of the mandrel is a function of the density detected by the density sensor and the type of fabric passing into the calender. In still yet another embodiment, the adjustment in rotation speed of the mandrel is time delayed to account for the time delay between the time the cord density is sensed and the time the mandrel is to capture the cords. During the cord capture process, the mandrel is rotated while simultaneously being moved laterally toward the center of the fabric. The density sensor which is used to detect the cord density of the fabric can be positioned closely adjacent to the point the grooves on the mandrel capture a cord or be spaced at some distance laterally from the point the grooves on the mandrel capture a cord. When the density sensor is spaced at some distance laterally from the point the grooves on the mandrel capture a cord, a time period must pass before the grooves begin capturing the cords that were sensed by the density sensor. This time period is a function of the speed at which the mandrel is being moved laterally toward the center of the fabric. In one specific aspect of this embodiment, the time period is a function of the speed at which the mandrel is being moved laterally toward the center of the fabric and the speed at which the mandrel is capturing the cords in the grooves. In another specific aspect of this embodiment, the time period is a function of the speed at which the mandrel is being moved toward the center of the fabric, the speed at which the mandrel is capturing the cords in the grooves and the type of fabric.

In accordance with still yet another aspect of the present invention, the speed at which the mandrel is moved laterally toward the center of the fabric is a function of the density of cords detected by the density sensor. The speed of lateral movement of the mandrel increases or remains the same when a large cord density is detected. The speed of lateral movement of the mandrel decreases or remains the same when a small cord density is detected. In one embodiment, the speed of lateral movement of the mandrel is proportional of the cord density detected by the density sensor. In another embodiment, the speed of lateral movement of the mandrel is at least partially controlled by a feedback control loop. In one specific aspect of this embodiment, the current speed of lateral movement of the mandrel is measured and/or sensed and this actual speed is compared to a signal produced from the density sensor which signal is a function of the density of the fabric cords. The compared signals then produce a signal to cause the speed of lateral movement of the mandrel to increase, decrease or remain the same. In yet another embodiment, the speed of lateral movement of the mandrel is a function of the density detected by the density sensor and the type of fabric passing into the calender. In still yet another embodiment, the adjustment in speed of lateral movement of the mandrel is time delayed to account for the time delay between the time the cord density is sensed and the time the mandrel is to capture the cords.

In accordance with a further aspect of the present invention, the speed at which the mandrel rotates when capturing the cords and/or the speed of lateral movement of the mandrel toward the center of the fabric is a function of the density of cords detected by the density sensor. The speed of rotation of the mandrel and/or the speed of lateral movement of the mandrel increases or remains the same when a large cord density is detected. The speed of rotation of the mandrel and/or the speed of lateral movement of the mandrel decreases or remains the same when a small cord density is detected. In one embodiment, the speed of the rotation of the mandrel and/or the speed of lateral movement of the mandrel is proportional of the cord density detected by the density sensor. In another embodiment, the speed of rotation of the mandrel and/or the speed of lateral movement of the mandrel is at least partially controlled by a feedback control loop. In yet another embodiment, the speed of rotation of the mandrel and/or the speed of lateral movement of the mandrel is a function of the density detected by the density sensor and the type of fabric passing into the calender. In still yet another embodiment, the adjustment in rotation speed of the mandrel and/or the speed of lateral movement of the mandrel is time delayed to account for the time delay between the time the cord density is sensed and the time the mandrel is to capture the cords.

In accordance with still a further aspect of the present invention, the adjustment to the rotation speed of the mandrel and/or to the lateral speed of the mandrel as a function of cord density is terminated once the edge detector on the mandrel detects the edge of the fabric. In one embodiment, once the edge of the fabric is detected, the direction of rotation of the mandrel is automatically controlled to maintain the edge of the fabric in a set position so that the fabric is properly conveyed into the calender. In another embodiment, once the edge of the fabric is detected, the support for the mandrel is moved to a preset position so that the fabric is properly conveyed into the calender.

In accordance with still yet a further aspect of the present invention, the density sensor used to detect the density of the cords in the fabric is a light sensor. The light sensor generates a certain light intensity and directs the light toward the fabric. The light sensor includes a light detector which receives the light that passes through the fabric. The reduction in light intensity of the light received by a light detector is a function of the cord density in the fabric. The less light received by the light detector, the greater the cord density. The more light detected by the light detector, the less the cord density. In one embodiment, the intensity of the light detected by the light detector is adjust to account for the type of fabric. Some fabrics absorb or reflect more light than others. In additional, some fabrics are made of a greater density of materials than others. These properties of the fabric can result in different light intensities being detected by the light detector for fabrics having the same cord density. By accounting for the type of fabric, greater accuracies in cord density detection are obtained. In accordance with another embodiment, the density sensor is a light sensor, magnetic sensor, an electromagnetic sensor, an sound wave sensor and/or contact sensor. In one specific aspect of this embodiment, the light sensor generates visible light to determine the density of the cords of the fabric. In another specific aspect of this embodiment, the magnetic sensor generates a magnetic wave with is used to determine the density of the cords of the fabric. In still another specific aspect of this embodiment, the electromagnetic wave sensor generates microwaves, radio waves, infrared light, ultraviolet light, etc. to determine the density of the cords of the fabric. In still another specific aspect of this embodiment, the sound wave sensor generates audible or non-audible sound waves to determine the density of the cords of the fabric. In still another specific aspect of this embodiment, the contact sensor engages the cords of the fabric to determine the density of the cords of the fabric. Typically, the contact sensor is positioned on the mandrel. The contact sensor detects the number cords contacting the detection section per length of the detection section. The larger the number of cords detected, the higher the density of cords on the detection section. The smaller the number of cords detected, the lower the density of cords on the detection section. In still yet another specific aspect of this embodiment, the light sensor, magnetic sensor, an electromagnetic sensor, an sound wave sensor and/or contact sensor is spaced from the mandrel and/or one or more components of the sensor is positioned on the mandrel. In still a further embodiment, two or more density sensors are used to determine the density of the cord. In one specific embodiment, two or more of the density sensors are the same type of sensor. In another specific embodiment, two or more density sensor are of a different type or sensor.

In accordance with another aspect of the present invention, the front portion of the mandrel includes a detection section have a generally uniform cross-sectional area and generally few, if any, cord grooves. The detection section is designed to facilitate in the detection of the cord density of the fabric prior to the cords being captured by the grooves on the surface of the mandrel. In one embodiment, the detection section is generally smooth so as not to cause additional bunching of the cords as the fabric is moved across the surface of the detection section. In another embodiment, the surface of the detection section is generally parallel to the surface of the density sensor. In still another embodiment, the detection section is has a shape that is generally the same as the shape of the grooved section of the mandrel. In one specific aspect of this embodiment, when the mandrel is generally cylindrical in shape, the detection section is generally cylindrical in shape. In yet another embodiment, the detection section is designed to reflect light produced from a light emitter of the density sensor back to a light detector of the density sensor. In one specific aspect of this embodiment, the density sensor is positioned above and/or below the fabric to cause light from the light emitter to pass through the fabric, reflect off the surface of the detection section of the mandrel and back to the light detector in the density sensor. In still another embodiment, the detection section of the mandrel includes a light emitter to cause light to pass through the fabric on the detection section and to a light sensor positioned above and/or below the fabric. In still yet another embodiment, the detection section of the mandrel includes a light detector to detect light that is produced by a light emitter positioned above and/or below the fabric and which light has passed through the fabric. In a further embodiment, the detection section of the mandrel includes a light emitter and a light detector to cause light to pass through the fabric, reflect off of the fabric and/or a reflector positioned above and/or below the fabric, and to detect the light reflected back to the light sensor in the detection section.

In accordance with still another aspect of the present invention, the front portion of the mandrel includes a leading edge that is tapered so that the cords of the fabric slide up the taper as the mandrel moves laterally toward the center of the fabric. In one embodiment, the grooves on the mandrel begin at the end of the tapered end. In another embodiment, the tapered end terminates at beginning of the detection section on the front end of the mandrel and the detection section terminates at the beginning of the cord captured grooves on the mandrel.

In accordance with yet another aspect of the present invention, a cord rod is used in conjunction with the mandrel to maintain the captured cords within the grooves in the surface of the mandrel. The cords in the fabric are held together by strings commonly referred to as picks. The picks run along the width of the fabric. Typically, the fabric includes about 1–4 picks per inch of fabric. When the cords of the fabric are captured in the grooves of the mandrel, the picks, upon encountering the grooves, tend to cause the cords to lift out or pop out of the grooves. When one or more cords lifts out of the grooves in the mandrel, the cords can bunch up or spread out along the edge of the fabric. A cord rod is used in conjunction with the mandrel to inhibit or prevent a the cords of the fabric from lifting or popping out of the grooves once the cord has been captured in the groove. In one embodiment, the cord rod is a generally rigid structure that is closely spaced to the grooved surface of the mandrel and extends at least partially the axial length of the grooved portion of the mandrel. In this arrangement, the cord rod functions as a ceiling to the mandrel and reduces the occurrences of the cords completely lifting or popping out of the grooves in the mandrel. In one specific aspect of this embodiment, the cord rod is generally uniformly spaced from the grooved surface of the mandrel. In another specific aspect of this embodiment, at least a portion of the cord rod is spaced from the grooved surface of the mandrel a distance that is less than or equal to the diameter of the cords in the fabric. When the cord rod is positioned from the mandrel a distance that is less than or equal to the diameter of the cords in the fabric, the cord rod effective prevents a cord in a groove from lifting out of a groove and wandering on the surface of the mandrel or over to another groove in the mandrel. When this spacing of the cord rod from the mandrel exists at the beginning of the grooved portion of the mandrel, the cord rod prevents more than one cord from entering a groove during capture of the cords. In still another specific embodiment, the cord rod at least extends the complete axial length of the grooved portion of the mandrel. In still yet another specific embodiment, the cord rod is made of a material having a small amount of flexibility. In another embodiment, the cord rod is fixed in positioned with respect to the mandrel. In still another embodiment, the cord rod is adjustably positionable with respect to the mandrel. The adjustable cord rod enables the distance of the rod from the mandrel and/or the distance profile of the cord rod along the axis of the mandrel to be adjusted to accommodate different types of fabric. In still yet another embodiment, the cord rod is positioned closely adjacent to the mandrel during the process of capturing the cords in the grooves of the mandrel. In a further embodiment, the cord rod is positioned closely adjacent to the mandrel after the cords have begun to be captured in the grooves or after the mandrel has completed capture of the cords in the grooves.

In accordance with still yet another aspect of the present invention, the cords at or near the edge of the fabric are spread to a desired cord distribution by raising or lowering a grooved mandrel into contract with the edge of the fabric and rotating the mandrel in at least one direction. After some fabrics have been spread by one or more bowed spreaders or other spreading arrangement, the cord distribution in these fabrics is generally uniform. However, the density at the edges of the fabric can be slightly greater or lesser in density than the remaining body of the fabric. Furthermore, some fabrics that are directly rolled off the roll of fabric have a cord distribution that is generally uniform. For these fabrics, it has been found that the cord distribution at the edge of these fabrics can be quickly redistributed into a uniform and desired cord distribution by moving the grooved mandrel surface into contact with the edge of the fabric without first having to capture the cords one at a time in the grooves. Due to the fact that the cord distribution at the edge of the fabric is not overly dense or overly spread out, the grooves in the mandrel quickly capture the cords and arrange the cords into the grooves to create a desired cord distribution. In one embodiment, the mandrel is rotating in one direction when the grooved surface of the mandrel is moved into contact with the fabric. In another embodiment, the mandrel is not rotating when the grooved surface of the mandrel is moved into contact with the fabric. In still another embodiment, the mandrel is rotated in a single direction for a select period of time until a majority of the cords are positioned in the grooves of the mandrel. In yet another embodiment, the mandrel is rotated in one direction for a select period of time and then in the opposite direction for a select period of time until a majority of the cords are positioned in the grooves of the mandrel. In one specific aspect of this embodiment, the sequence of rotating the mandrel in one direction for a select period of time and then rotating the mandrel in the opposite direction for a select period is repeated for a plurality of times until a majority of the cords are positioned in the grooves of the mandrel. In another specific aspect of this embodiment, the selected time of rotating the mandrel in one direction is different from the selected amount of time for rotating the mandrel in the opposite direction. In still another specific aspect of this embodiment, the selected time of rotating the mandrel in one direction is generally the same as the selected amount of time for rotating the mandrel in the opposite direction. In yet another specific embodiment, the select amount of time for rotation in one or more directions is about 1–20 seconds and/or about 0.1–20 revolutions of the mandrel. In still yet another embodiment, the full grooved surface of the mandrel is moved into contact with the fabric. In a further embodiment, a portion of the grooved surface of the mandrel is moved into contact with the fabric. In yet a further embodiment, the mandrel is moved lateral until a plurality of grooves on the mandrel are positioned above or below a plurality of cords at the edge of the fabric, and then the mandrel is moved upwardly or downwardly to engage the fabric to cause a plurality of cords to be positioned in the grooves on the mandrel surface. In still a further embodiment, the edge detector control of the mandrel is deactivated until the rotating sequence of the mandrel for capturing the cords is complete. Thereafter, the automatic edge control is activated to move the edge of the fabric to a desired position on the mandrel. In still yet a further embodiment, the cord rod is moved into a closely adjacent position to the mandrel after the mandrel is moved into contact with the fabric. In another embodiment, the grooved mandrel is moved out of contact with the fabric after the grooves of the mandrel have partially or completely captured the cords of the fabric. After the cords have been partially or totally captures in the grooves, the cords at the edge of the fabric are in or closely in the desired cord distribution. When the mandrel is moved out of contact with the cords, the cords substantially remain in the same cord distribution. The mandrel is then moved back into contact with the cords of the fabric and the mandrel is rotated in one or more directions for a select period of time to recapture the cords in the grooves of the mandrel. This cords distribution sequence is very effective in obtaining the desired cord distribution in the fabric. During the cord capture process, most of the cords are properly distributed in the grooves. However, one or more of the cords may be improperly distributed due to a very high cord density during capture or a very low cord density during capture. When the captured cords are released by the mandrel and then recaptured by raising or lowering the mandrel into contact with the fabric, the few cords that were not previously properly distributed in the fabric are caused to be properly distributed by this second and subsequent cord distribution process. Consequently, this second cord distribution process is used to complement the first cord capturing and distribution process.

In accordance with a further aspect of the present invention, the edge spreader is activated when a fabric sensor detects an edge of the fabric. In one embodiment, the mandrel is moved laterally to engage the fabric and cause a plurality of cords in the fabric to be captured in the grooves in the surface of the mandrel. In another embodiment, the mandrel is moved laterally toward the fabric until a plurality of grooves in the mandrel are positioned above or below a plurality of cords in the fabric. Thereafter, the mandrel is moved into engagement with the cords of the fabric resulting in the cords of the fabric being captures by the grooves in the mandrel. In one specific aspect of this embodiment, a position sensor is used to detect the fabric edge to determine the lateral distance the mandrel is moved before being moved into engagement with the fabric. Typically, the position sensor is spaced about 0.125–4 inches from the edge sensor on the mandrel, and preferably about 0.25–1.5 inches from the edge sensor on the mandrel. The edge sensor is used to control the desired edge position of the fabric as the fabric is directed into the calender. In another specific aspect of this embodiment, the mandrel is rotated as the mandrel is moved into contact with the fabric; however, the mandrel can be temporarily rotated in the opposite direction. Typically, the mandrel is rotated in a direction that causes the cords to move toward the edge sensor. In addition, the mandrel is typically rotated at a constant speed until the edge of the fabric is sensed by the edge sensor; however, the rotation speed of the mandrel can be varied. In still another specific aspect of this embodiment, an automatic edge control mechanism is activated upon the edge sensor sensing the edge of the fabric. In still yet another specific aspect of this embodiment, the rotational control of the mandrel executes a rotation direction sequence and/or a rotation speed sequence upon the edge sensor sensing the edge of the fabric prior to an automatic edge control mechanism being activated. The rotation direction sequence and/or the rotation speed sequence is used to cause the cords in the fabric to be captured in the grooves of the mandrel prior to the edge control mechanism being activated.

The primary object of the present invention is the provision of an edge spreader, a system of using the edge spreader and a method of using the edge spreader, which spreader, system and method allow accurate width control of a fabric entering a calender, without bunching of the cords in the edge portion of the fabric.

Another object of the present invention is the provision of a spreader, system and method, as defined above, which spreader, system and method substantially reduce the amount of scrap in the rubberized fabric being processed in a standard calender line of the type used in producing tire making rubberized material.

Still a further object of the present invention is the provision of a spreader, system and method, as defined above, which spreader, system and method operates automatically and requires only a short time and no appreciable manual labor at the entrant end of the calender.

Still a further object of the present invention is the provision of a spreader, system and method, as defined above, which spreader, system and method is an automatic machine designed to provide substantially improved cord count on the outermost 3–5 inches at the edge of a fabric comprising longitudinally extending cords.

A further object of the present invention is the provision of a spreader, system and method, as defined above, which spreader, system and method includes a cantilevered grooved mandrel which is rotated and moved inwardly to capture the cords of the fabric and then used to control the final width of the fabric as it enters the calender. The mandrel has a helical groove and is rotated and proportionally advanced in a manner that "screws" the fabric onto the groove without excessive lateral force on the fabric as it is being pulled to the desired position on the mandrel and then maintained at the desired width for entry into the calender for rubberizing of the fabric.

Yet another object of the present invention is the provision of a sensor, system and method, as defined above, which sensor, system and method involves sensors and axial position transducers that determine the relative position of the edge of the fabric and compares this position to the target width or desired width of the fabric and also determines the amount of fabric engaged on the mandrel groove for the subsequent controlling operation.

A further object of the present invention is the provision of a spreader, system and method, as defined above, which spreader, system and method employs dynamic means, such as an error amplifier, for monitoring the edge of the fabric after the fabric has been captured on the mandrel of the spreader and the concept of screwing or unscrewing the cords to control the desired width of the fabric.

Another object of the present invention is the provision of a spreader, system and method, as defined above, which spreader, system and method senses the density of the cords in the fabric and adjusts one or more parameters of a control process to properly space the cords in the fabric.

Still another object of the present invention is the provision of a spreader, system and method, as defined above, which spreader, system and method utilizes a modified mandrel to facilitate in the sensing of the density of the cords in the fabric.

Yet another object of the present invention is the provision of a spreader, system and method, as defined above, which spreader, system and method maintains the captured cords of the fabric in the grooves of the mandrel.

Still yet another object of the present invention is the provision of a spreader, system and method, as defined above, which spreader, system and method moves a grooved mandrel into contact with a fabric and rotates the mandrel in multiple directions to obtain a desired density of the cords in the fabric.

A further object of the present invention is the provision of a spreader, system and method, as defined above, which spreader, system and method which senses the density of the cords in a fabric and adjusts the rotational speed of the mandrel and/or the lateral speed of the mandrel as a function of the density of the cords and/or of the type of fabric.

These and other objects and advantages will become apparent to those skilled in the art upon the reading and following of this description taken together with the accompanied drawing.

BRIEF DESCRIPTION OF THE DRAWINGS

Reference may now be made to the drawings, which illustrate various embodiments that the invention may take in physical form and in certain parts and arrangements of parts wherein.

PREFERRED EMBODIMENT OF THE PRESENT INVENTION

Figure 1:
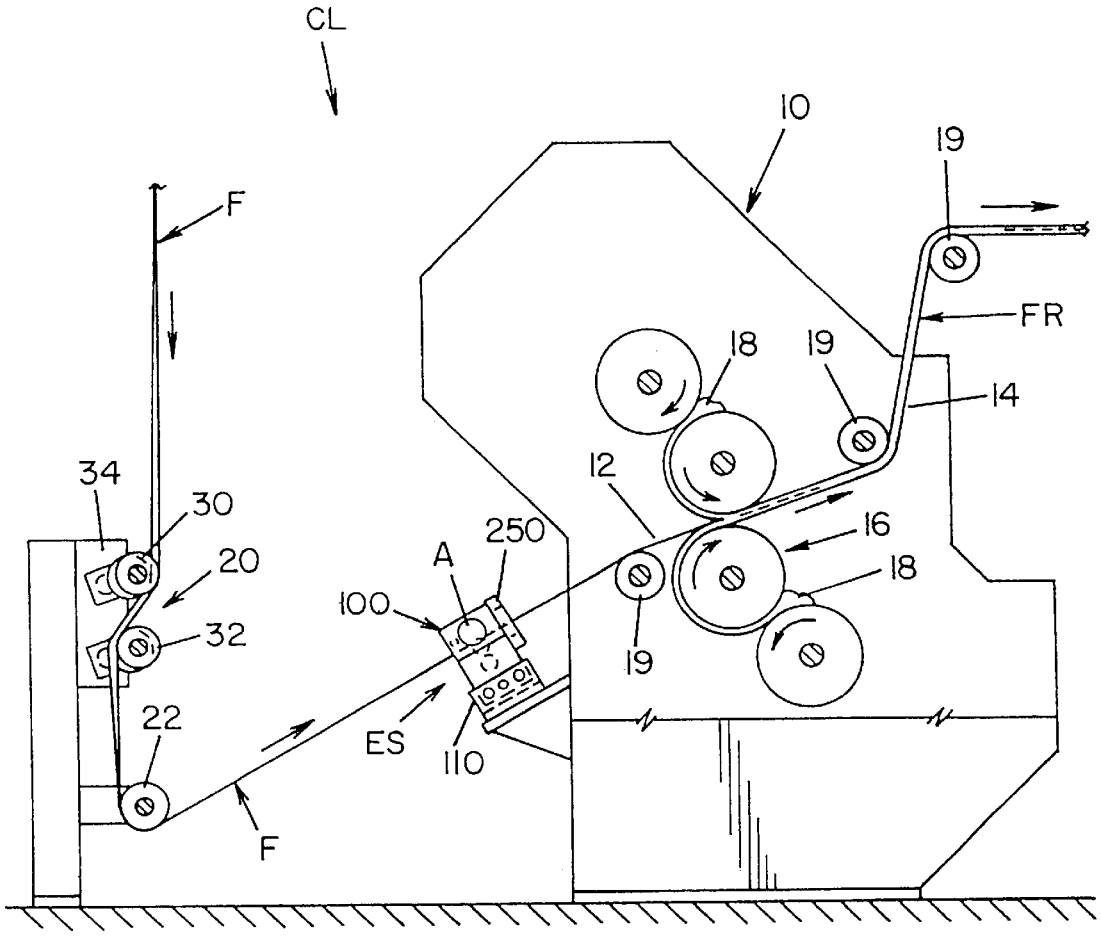
FIG. 1 is a side elevational view of the calender section of a calender line with the present invention located at the entrant end of the calender.

Referring now to the drawings wherein the showings are for the purpose of illustrating preferred embodiments of the invention only and not for the purpose of limiting same, FIG. 1 illustrates a calender line CL with a calender 10 for treating a fabric F. Specifically, calender 10 is designed to apply a rubber substance to fabric F and convert fabric F into a rubberized fabric or sheet FR for the purposes of manufacturing tires. As can be appreciated, other types of fabric treatments can be performed in calender 10. In accordance with standard practice for forming rubberized fabric or sheet FR, calender 10 has an entrant end of entrant or nip 12, an exit end 14 and roll stacks 16 for applying rubber 18 onto fabric F as it moves through the calender in a path determined by guide rolls 19. Six to eight feet prior to entrant end 12 of calender 10 there is provided a width control bowed spreader 20 for spreading fabric F to a controlled width for delivery to the calender around guide roll 22. In accordance with the present invention, a novel edge spreader ES is provided on both outside edges of fabric F immediately before nip 12. Only one of the edge spreaders is shown in FIG. 1; however, each of the edge spreaders is identical and performs a function which will be explained when disclosing the aspects of the present invention. In operation, spreader 20 attempts to spread fabric F to the known desired width, after which it is spread by transversely spaced edge spreaders ES and is then rubberized to form fabric FR.

Figure 2:
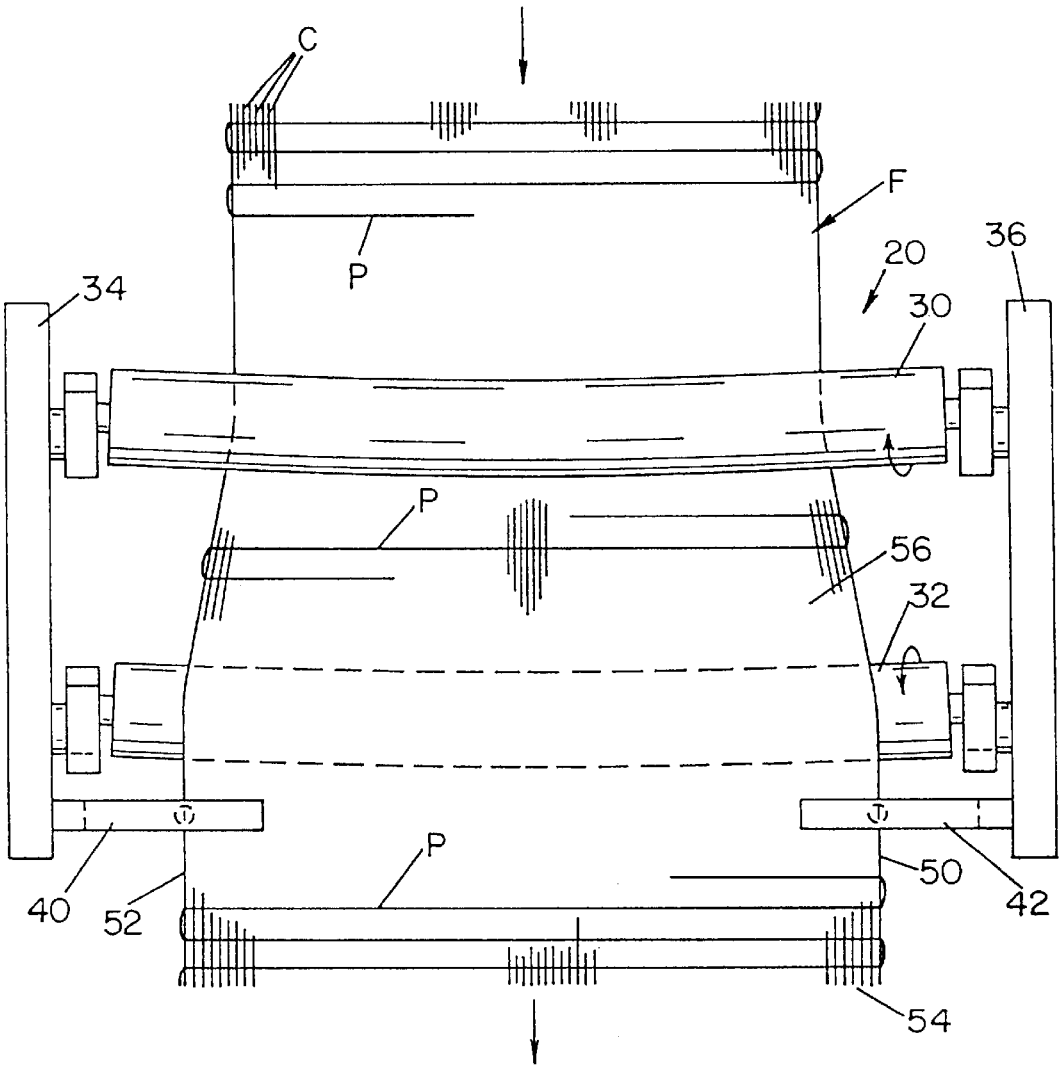
FIG. 2 is a top plan view of the bowed spreader spaced upstream of the invention for spreading the fabric as it enters the area controlled by the present invention.

The bowed spreader 20 is illustrated in FIG. 2 as including bowed rolls 30, 32 with transversely spaced supports 34, 36 and outlet edge sensors or detectors 40, 42 such as, but not limited to, North American edge detectors H3111. An appropriate standard feedback arrangement uses the detected position of edges 50, 52 of fabric F to control the bowed amount of rolls 30, 32 so that the outlet fabric has edges 50, 52 spread to the desired position, or known desired transverse locations, consistent with the desired width of fabric F as it progresses toward calender 10.

Figure 3:
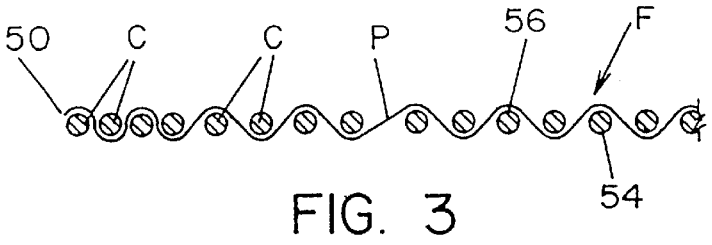
FIG. 3 is a schematic partial cross-sectional view illustrating the edge portion of the fabric as spread by the bowed spreader shown in FIG. 2.
Figure 4:
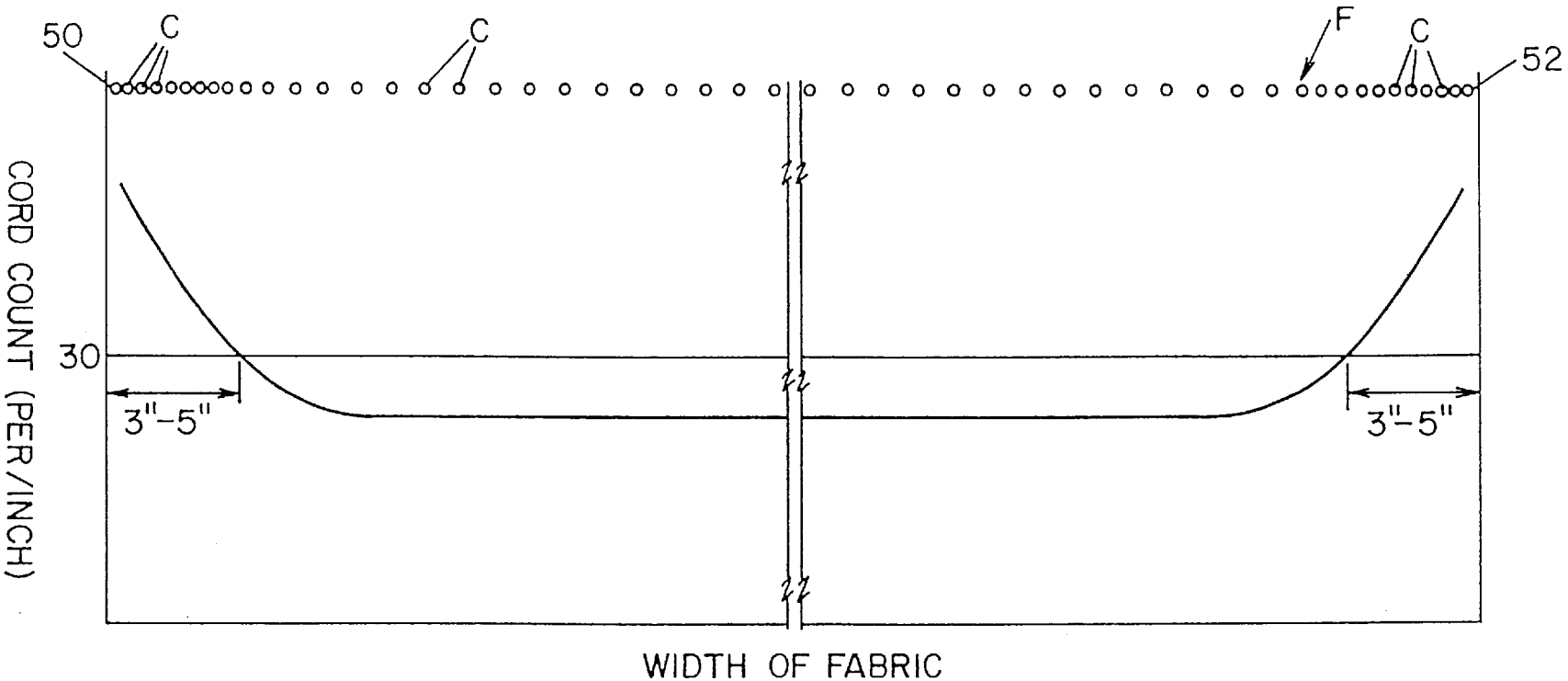
FIG. 4 is a graph showing cord distribution across a fabric and illustrative of the distribution when a width spreader is employed without controlling the distribution of the cords in the edge portions of the fabric.

Fabric F not only has transversely spaced edges 50, 52 but also a lower side or surface 54 and an upper side or surface 56 to define the boundaries of longitudinally extending tire reenforcing cords C spaced laterally across the fabric between edges 50, 52 preparatory to rubberizing fabric F in calender 10 as the fabric moves in a given path illustrated in FIG. 1 to the nip of calender 10. Each different type of fabric F has a preselected cord distribution, normally in the range of about ten to thirty cords per transverse inch, and the cords C are held together by a thread or pick P woven through the cords at a distribution of about 1–3 picks per inch in the longitudinal direction. At roll 22, spreader 20 attempts to arrange edges 50, 52 of fabric F in the proper spacing to control the width of the fabric as it is directed to the calender. Since the spreading of the fabric by bowed roll spreader 20 involves merely controlling width, cords C tend to bunch at edges 50, 52, as shown in FIGS. 3 and 4. The cord distribution for the spread fabric is shown in the upper portion of FIG. 4 where the graph illustrates that the actual cord distribution adjacent edges 50, 52 is greater than the desired cord distribution. Due to the spreading action of the spreaders upstream of spreader 20 and spreader 20 itself, the central portion of fabric F has a cord distribution slightly less than the desired distribution. The center portion is not a real problem; however, the bunching of cords C at edges 50, 52 does produce scrap which must be trimmed from strip FR as it leaves calender 10.

Figure 5:
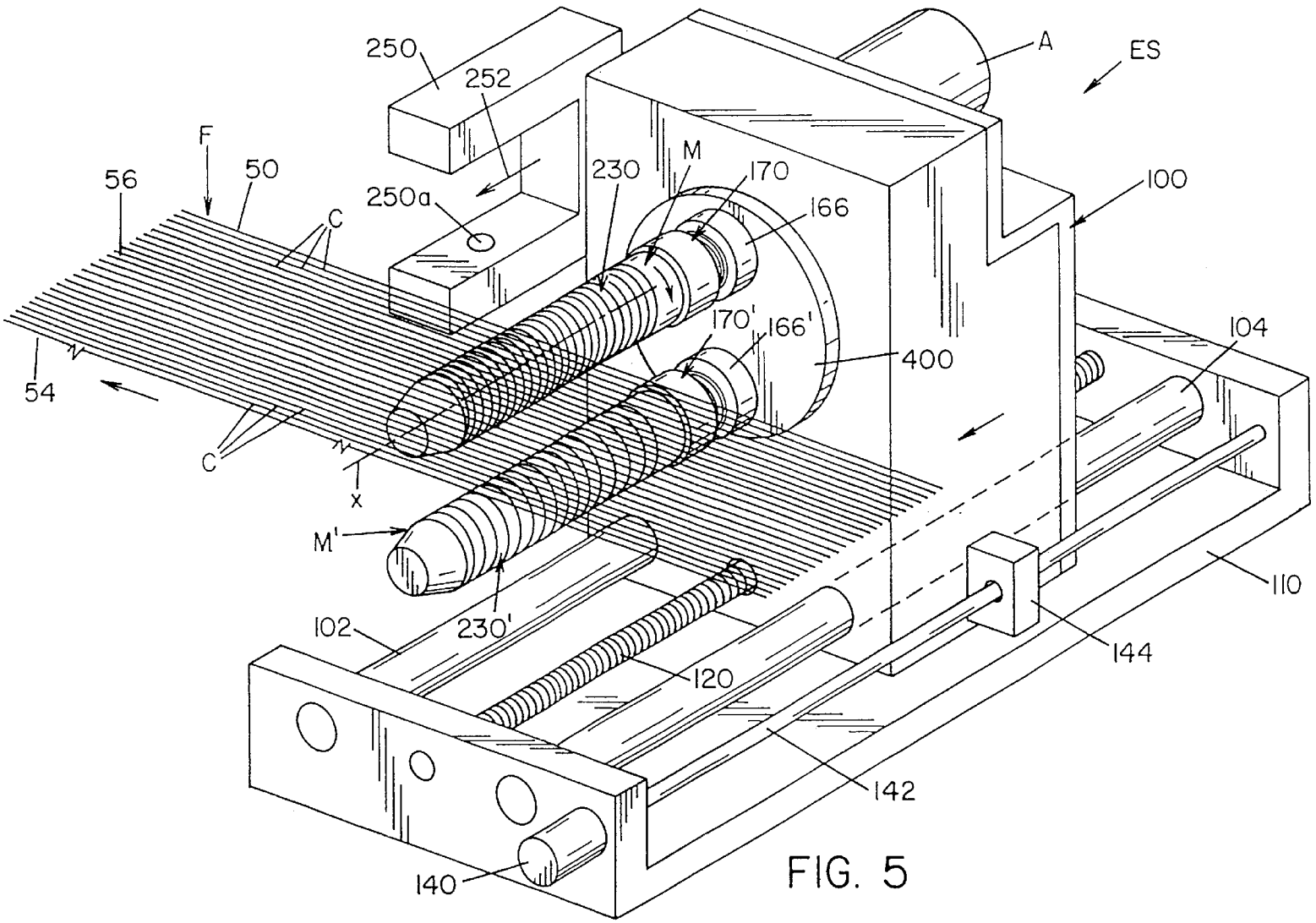
FIG. 5 is a pictorial view of an edge spreader constructed in accordance with the present invention.
Figure 6:
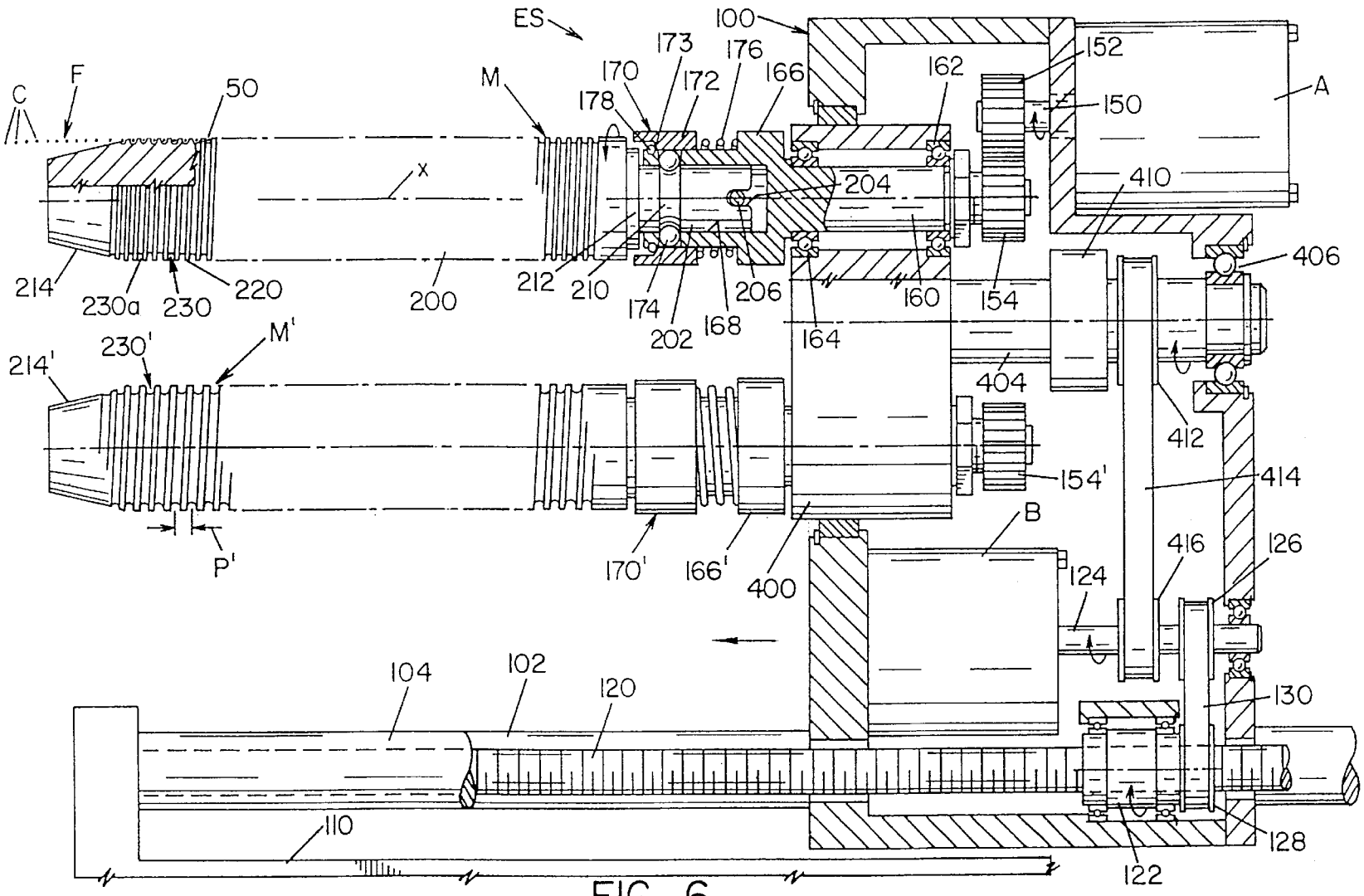
FIG. 6 is a cross sectional view of the preferred embodiment of the present invention as illustrated in FIG. 5.

Referring now to FIGS. 5 and 6, mandrel M is rotatably mounted on support frame or structure 100 which is laterally movable on a base 110 by sliding action on transversely spaced rods 102, 104. To move support structure 100 toward fabric F, or away from fabric F, a lead screw 120 is engaged by a rotatable nut 122 driven from shaft 124 of motor B through pulleys 126, 128 and a timing belt 130. As can be appreciated, gears can be used in conjunction with or instead of the timing belts. An axial or linear transducer 140 has a transversely extending sensing rod 142 with a positional pick-up 144 mounted on support structure 100. The linear position of pick-up 144 is sensed by rod 142 and is transmitted to the microprocessor controlling spreader ES. During normal operation, motor B rotates nut 122 driving support frame or structure 100 toward or away from fabric F.

To rotate mandrel M, there is a motor A, best shown in FIG. 6, wherein a shaft 150 drives gear 152 that is meshed with gear 154 to drive spindle 160 rotatably supported in axially spaced bearings 162, 164 and having an outwardly extending rotatable head 166 with a central mounting bore 168. To connect mandrel M rotatably on support structure 100 there is provided a standard quick connect device 170 including a ring 172 with a conical cam 173 that coacts with balls 174 and is forced to the left by spring 176. Snap ring 178 limits the left hand movement of ring 172 caused by spring 176. As can be appreciated, other quick connect arrangements can be used.

Mandrel M includes a body portion 200 having a rearwardly extending mounting shaft 202 with a driving slot 204 coacting with pin 206 in bore 168 of spindle 160. A cylindrically extending groove 210 is provided on shaft 202 rearward of collar 212 for receiving balls 174 of quick connect device 170.

Figure 7:
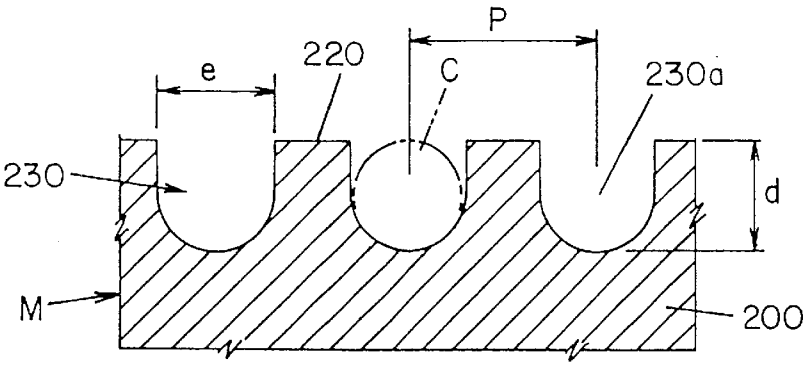
FIG. 7 is a cross sectional view of a portion of the grooved mandrel, enlarged for showing aspects of the mandrel in more detail.

In operation, ring 172 is forced to the right against spring 176 so that balls 174 can move outwardly beyond cam 173. This releases the balls from groove 210 so shaft 202 can be removed from mounting bore 168. The reverse action is accomplished for holding the mandrel in place. Pin 206 is rotated by motor A to rotate mandrel M about its central axis x which is the center of the outer cylindrical surface 220 of the mandrel. This outer cylindrical surface includes a helical groove 230 best shown in FIGS. 7 and 8. Groove 230 defines axially spaced convolutions 230*a* having a depth d, which is preferably no greater than the diameter of cords C. Preferably, the depth of groove 230 is about equal or slightly less than the width E which is generally equal to, but slightly large than, the diameter of the cords. Convolutions 230*a* have an axial spacing or pitch P corresponding to the cord distribution of the fabric being processed by the calender line. For example, if the cord distribution of the fabric is thirty cords per inch, the pitch of groove 230 would be about 1/30 of an inch.

Figure 8:
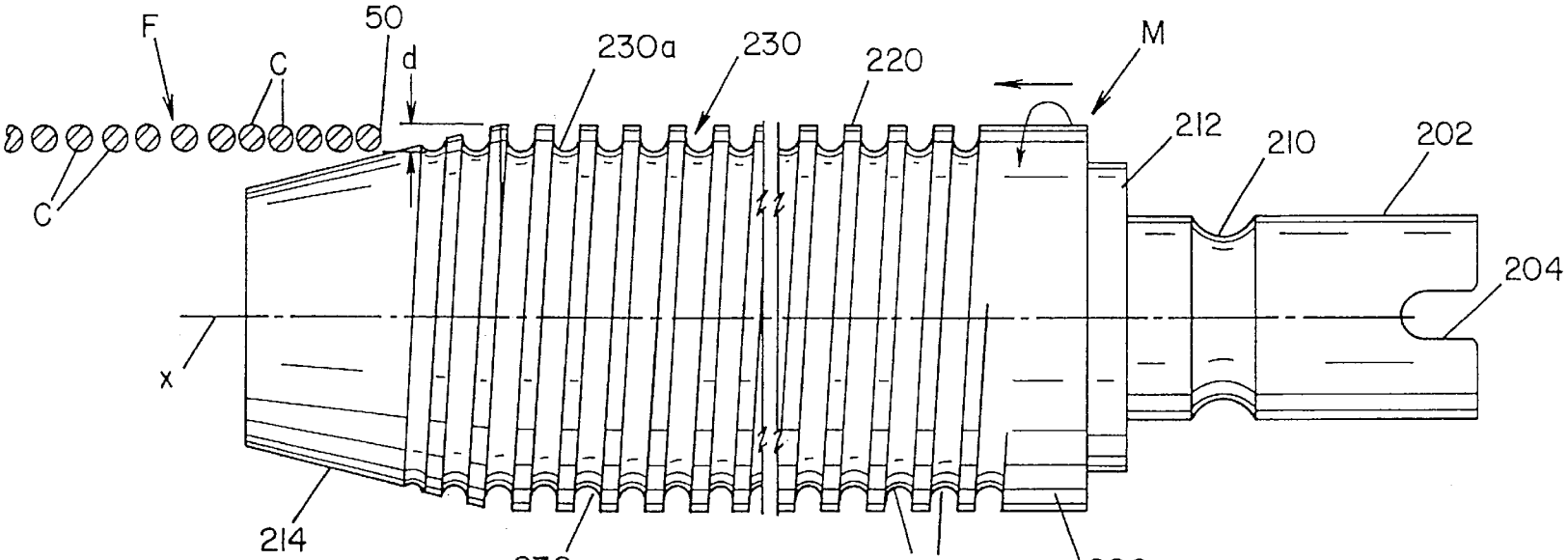
FIG. 8 is a side elevational view of the grooved mandrel as it approaches the fabric in the capturing mode of operation which mandrel is a separable sub assembly.
Figure 9:
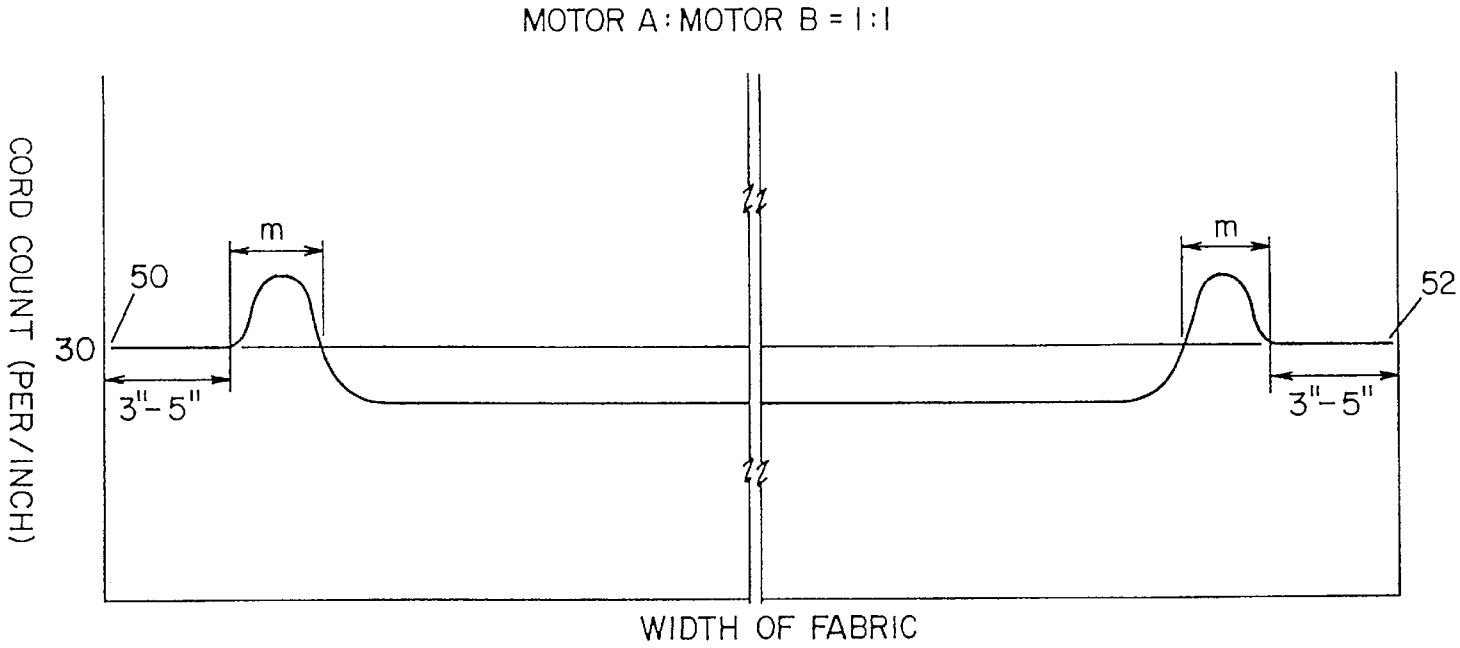
FIG. 9 is a graph similar to FIG. 4 illustrating operation of the preferred embodiment of the invention when the inward linear rate of movement of the mandrel is coordinated with the rotational speed of the mandrel for a given cord count or distribution wherein the rotational and linear rates have a ratio of 1:1.
Figure 10:
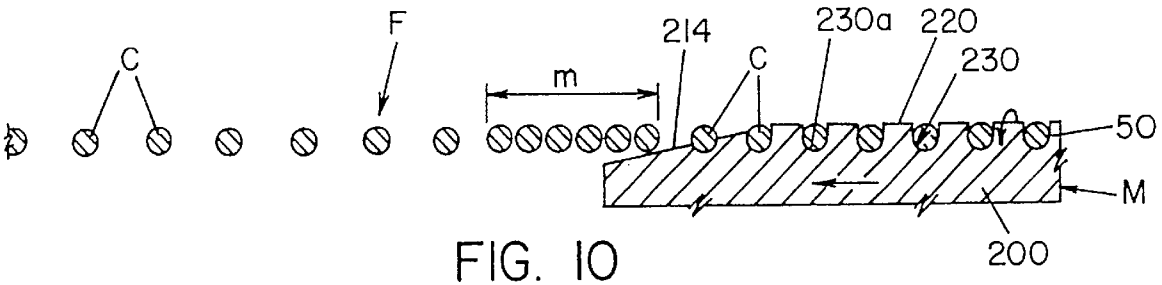
FIG. 10 is a side elevational view showing a part of the inwardly moving, rotating mandrel as it is capturing the edge cords of the fabric in accordance with the speed of relationship illustrated in the graph of FIG. 9.

As shown in FIGS. 6 and 8, rotation of mandrel M by motor A as motor B moves the mandrel forward by moving structure 100, to capture the cords at edge 50 of fabric F as this edge is engaged by tapered nose 214 of mandrel M. Cords C progress along tapered nose 214 into groove 230. Continued rotation of the mandrel pulls the cords forward into groove 230, as illustrated in FIG. 10. By moving mandrel M forward while rotating the mandrel, cords C are captured in helical groove 230 as the mandrel is moved forward toward the center of the fabric. If the rotational rate of speed of mandrel M is greater than the corresponding rate of linear movement of the mandrel, rotation of the mandrel pulls the cords to the right, as shown in FIGS. 6 and 8. If the rate of rotation and the rate of linear movement are coordinated at a 1:1 ratio, as shown in the graph of FIG. 9, the edge 50 remains stationary as mandrel M is screwed under fabric F. Preferably, the rate of rotation and the rate of linear movement are coordinated at least at a 1:1 ratio. A ratio of less than 1:1 can result in the bunching of cords adjacent to mandrel M. Preferably, the rate of the inward linear speed is less than the coordinated rate of rotational speed so that there is an outward pulling action on the cords at edge 50. This pulling action evenly distributes the cord over the top of mandrel M and move the edge 50 to the right.

Movement of the fabric edge 50 to the right over mandrel M ultimately brings this edge into the view of detector 250. One type of detector that can be used is an H3111 manufactured by North American. When edge 50 is detected by detector 250 to be in a given position, an output signal is created on line 252 in accordance with standard practice. This signal is created even though the rate rotational speed is coordinated with the rate linear speed at a ratio of 1:1 so the mandrel merely moves under the edge 50 and the edge does not move to the right. When the speed rates are intentionally different, the mandrel moves toward the fabric and the fabric is pulled over the cylindrical surface of the mandrel. In either instance, ultimately edge 50 is detected by detector 250 to create a signal in line 252. When that occurs, motor A is stopped and held stationary. Motor B is reversed to pull edge 50 to the right to the desired position of this edge as determined by the axial transducer 140. Based upon the signal from axial transducer 140, Motor B shifts structure 100 to the right with respect to fixed frame 110, until the location of edge 50 detected by detector 250 is at desired position of edge 50 for the proper width of fabric F as it enters into the calender.

After structure 100 is shifted under the control of axial transducer 140 and until detector 250 is located at the proper position to control the desired width of fabric F, detector 250 is then used as a standard edge detector for monitoring and controlling the width of fabric F. This is accomplished by rotating mandrel M clockwise or counterclockwise when edge 50 deviates from the proper position as sensed by detector 250. The direction of rotation of the mandrel moves edge 50 inwardly or outwardly to control the edge to the set position of detector 250 during normal operation of the spreader ES. A separate spreader is located on both edges 50, 52 of fabric F to control the width by the control of the positions of edges 50, 52.

Figure 5A:
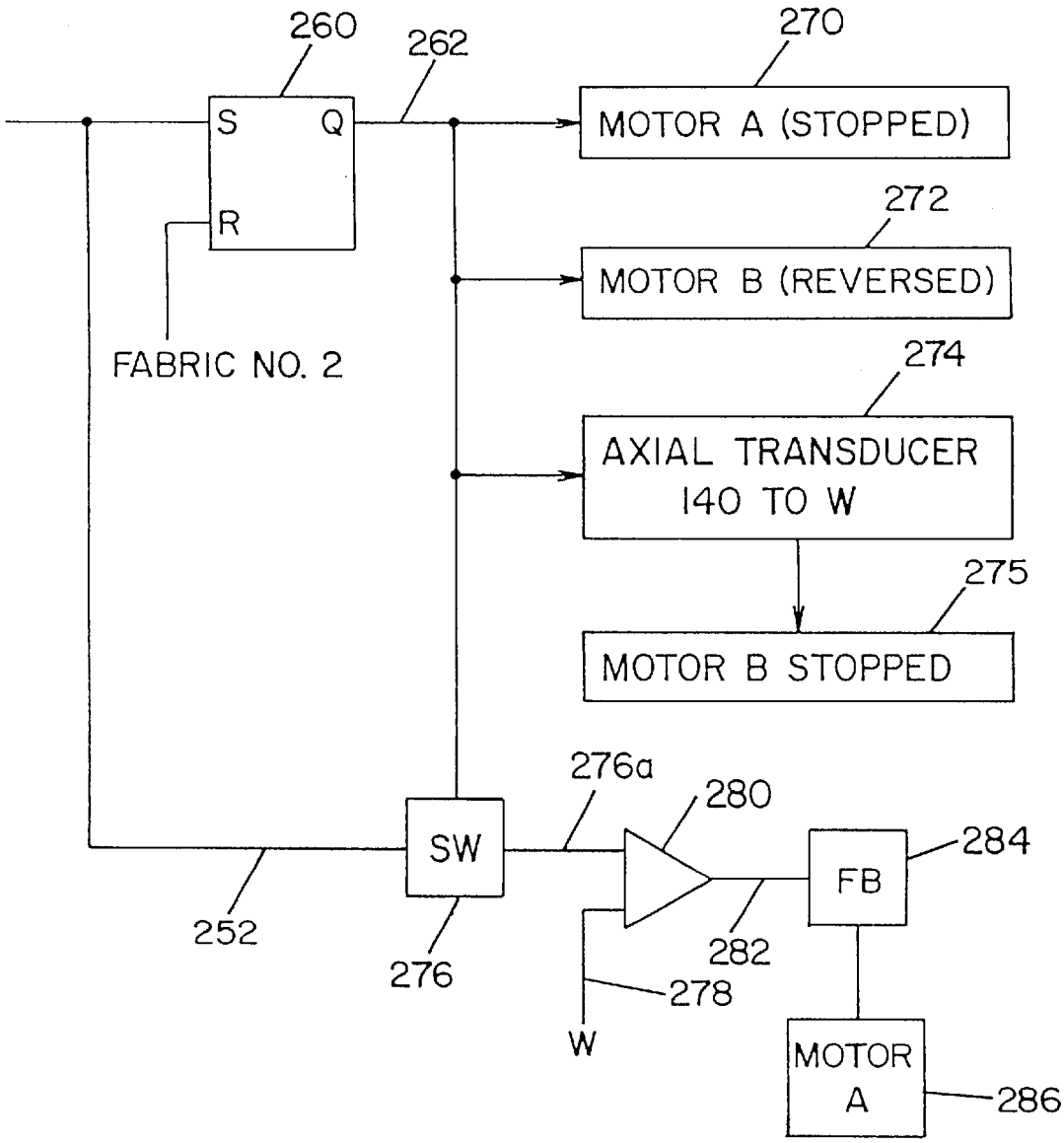
FIG. 5A is a block diagram showing a logic network for shifting the present invention, as illustrated in FIG. 5, between a capturing mode of operation and a spreading mode of operation for width control.

Control of the two spreaders ES is preferably by a microprocessor or PLC; however, other types of control systems can be used. A schematic block diagram of the overall operating characteristics of the spreader, as so far described, are shown schematically in FIG. 5A. During the capturing mode of operation, mandrel M is rotated by motor A and motor B shifts the mandrel forward until edge 50 reaches the setting of opening 250*a* of detector 250 to create a signal in line 252. This sets flip-flop 260 to create a logic 1 in output 262. The logic 1 in line 262 stops motor A so mandrel M is not rotating, as indicated by block 270. At that time, motor B is reversed as indicated by block 272. This action pulls the cords captured on mandrel M and starts spreading of the fabric.

This operational step is used in practice because when a new fabric F is spliced into the calender line, and has a necked down width substantially less than the desired final width W for the fabric as it is to be introduced into calender 10. Thus, during the initial capture mode of operation for a new fabric, mandrel M is "screwed" into the fabric until the edge is detected and then rotation is stopped and mandrel support structure 100 is moved outwardly to a desired position. The desired position is indicated by block 274 wherein axial transducer 140 determines that the detection point of detector 252 is at the desired position to control the width W of fabric F for a given fabric. Thereafter, transducer 140 stops motor B as indicated by block 275. Fabric F has been stretched and is ready for continuous, normal width control, which is accomplished with cords C properly spaced at the edge portions of the fabric. The cords are not bunched at edges 50, 52. This is a concept not heretofore accomplished in the art.

To maintain or monitor width W during normal operation of calender line CL, a software switch 276 directs the analog signal on line 252 to the output line 276*a* at the input of error amplifier 280. The other analog input to the error amplifier is the desired width W providing a representative analog signal in line 278. Thus, the output 282 of error amplifier 280 is the difference between the detected position of edge 50 at detector 250 and the known desired location for this edge to control width W of fabric F. Error amplifier 280 is directed to a feedback mechanism 284 for controlling the direction of rotation of the mandrel by way of motor A as indicated by block 286. Thus, after edge 50 has been captured by mandrel M and mandrel support structure 100 has been moved to the desired position, a standard error amplifier feedback control system is used to control the position of edge 50 by rotating mandrel M in the proper direction to regulate the actual position of edge 50. Of course, edge 50 could be controlled by moving mandrel M linearly; however, this would require detection of the actual position of the edge by a detector not movable with structure 100. In such a system, the actual position of the edge is detected and used for a feedback system to maintain width W.

If the rotational speed and linear inward speed used during the capturing mode are coordinated on a 1:1 basis, edge 50 stays in the same general lateral position and the bunched cords C at the edge 50, area m, are merely moved forward ahead of the mandrel as shown in FIGS. 9 and 10. This does allow edge 50 to be captured properly on mandrel M and held in the proper spacing during the spreading operation. Thus, the rotating and moving mandrel to capture the edge cords presents an advantage heretofore not obtainable in purely width controlled spreaders.

Figure 11:
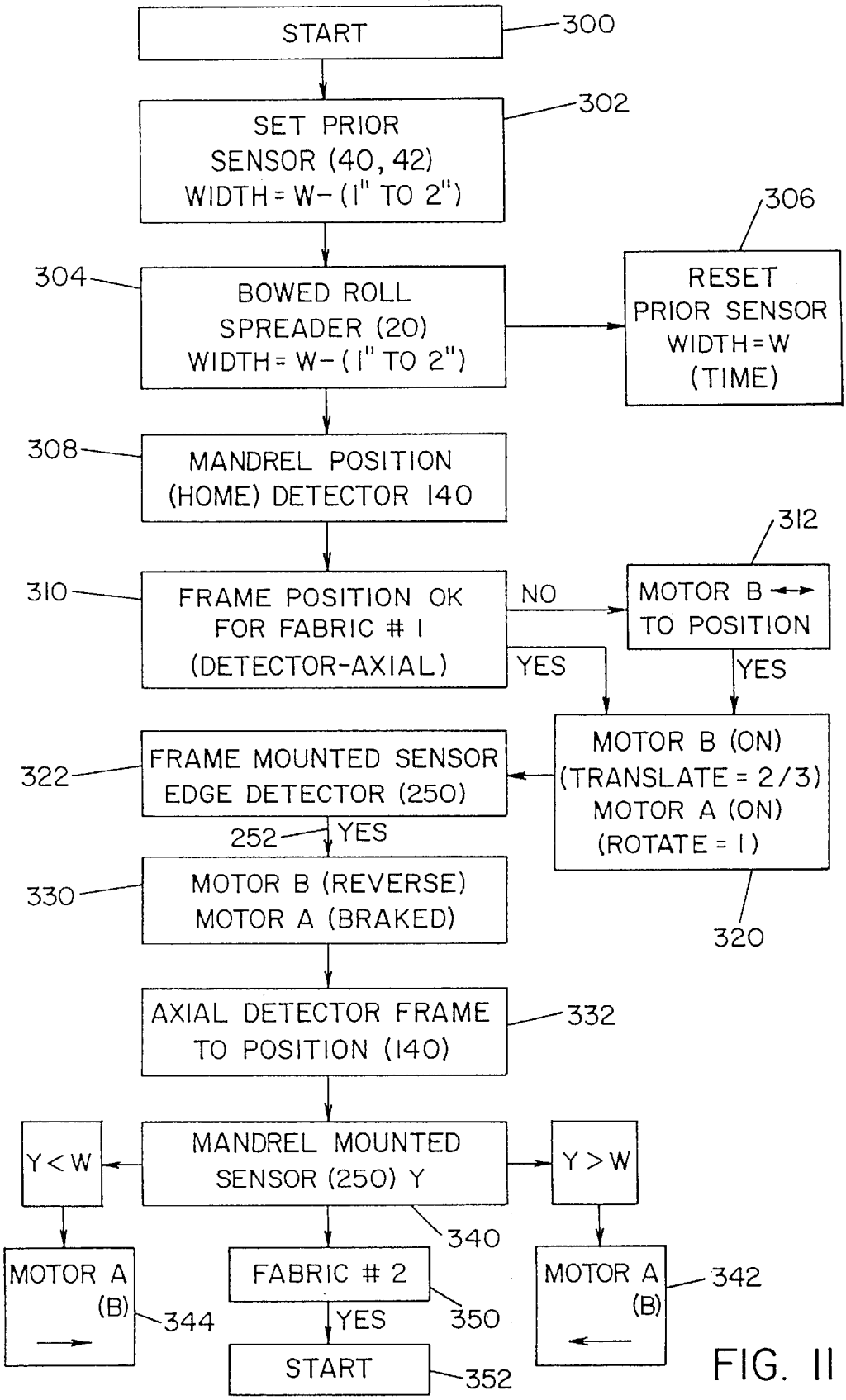
FIG. 11 is a block diagram showing the operating characteristics of the preferred embodiment of the present invention with certain optional characteristics.

Referring now to FIG. 11, a flow chart is shown which illustrates the operating steps of a system using the present invention in a system coordinated with a bowed roll spreader 20 as shown in FIGS. 1 and 2. These steps are preferably performed by software with hardware shown in FIGS. 2, 5, 5A and 6. In one aspect of the present invention, spreader 20, located before edge spreaders ES provides an important function during the capturing mode of operation of the edge spreaders ES. During the capture mode, bowed roll spreader 20 supplies fabric F to edge spreaders ES at a controlled width, which is slightly less than the actual control width for fabric F. This slightly narrower width assures that the cord capturing mode initiated when a new fabric is first introduced into the calender line exerts a pulling force or action on the edge 50. This is indicated by block or step 304. This reduced output for spreader 20 is maintained for less than two minutes, and preferably less than one minute, which is sufficient time for the novel edge spreaders to capture the cords at edges 50, 52 of fabric F. Thereafter, sensors 40, 42 are reset to the normal width W. This is indicated by block or step 306. The position of mandrel support structure 100 is detected by axial transducer 140, as indicated by block or step 308. If the mandrel support structure is in the proper "home" position, the capturing mode of operation is initiated by block or step 310. If the structure is not in the proper "home" position, motor B is operated structure 100 is moved on fixed frame 110 until the proper position is obtained. This is indicated by block or step 312. The capturing mode of operation then takes place as indicated by block or step 320. When edge 50 is detected as being in the set position of detector 250, a signal is created in line 252 as indicated by block or step 322. As explained in FIG. 5A, the signal in line 252 reverses motor B and stops rotation of mandrel M by motor A. This is indicated by block or step 330. The reversal of motor B draws edge 50 outward to the desired position as detected and determined by axial transducer 140 indicated by block or step 332. When mandrel support structure 100 is moved on frame 110 so detector 250 is set to the proper position of the edge for proper width W of fabric F, detector 250 is set at the desired position or known desired location for edge 50. Detector 250 is now the edge detector for the feedback control system to control the width of fabric F by maintaining the set position of the two edges 50, 52. This is indicated by block or step 340. The same procedure acts upon both edges 50, 52. Consequently, the width of fabric F is maintained at the desired value W for introduction into calender 10. As indicated by block or step 340, detector 250 detects the position of edge 50 which position is represented by Y. If Y is greater than W, motor A is rotated in one direction to move edge 50 to the left. If Y is less than W the opposite rotation of motor M is accomplished. These operations are indicated by blocks or steps 342, 344, respectively. The width is controlled by the positions of edges 50, 52 to give the proper width W. During normal run of fabric F, sensor 250 creates a signal to control edge 50 and a similar sensor on the other edge 52 controls its lateral position. The two detectors 250 are used to control the width of the fabric. In this manner, the width of the fabric is monitored and maintained.

When it is desired to process the next fabric, this is entered into the control and a signal is created as indicated by block or step 350. The parameters of operation for the fabric #2 are selected, such as "home" position, width W and cord distribution. A start sequence indicated by block or step 352 is then initiated. If this new fabric has a different cord distribution, than a new mandrel M' must be used in edge spreaders ES. An arrangement for rapidly accomplishing this objective is shown in FIGS. 5 and 6. The procedural steps shown in FIG. 11 are accomplished as software in the process controller used for operating the system and for performing the method as described.

If a different cord distribution be required for the next fabric, a rapid mandrel change mechanism is illustrated in FIGS. 5 and 6. Mandrel M' includes a pitch P' for helical groove 230'. Mandrel M' is positioned on spindle 166' carried by turret or ring 400 rotatably mounted in mandrel support structure 100 by bearing 406. Shaft 404 is rotatably mounted in bearing 406 to be indexed 180°, as illustrated in FIGS. 5 and 6. To cause this index action, a clutch 410 is actuated while motor B is rotating shaft 124. A micro switch or other proximity switch creates a signal to disconnect clutch 410 when ring 400 is rotated to the proper position where mandrel M is replaced by mandrel M'. When clutch 410 is energized, pulley 412 is driven by timing belt 414 from a pulley 416 driven by shaft 124. As can be appreciated, a gear arrangement can also be used. Thus, actuation of clutch 410 until ring 400 has been rotated 180° accomplishes a rapid exchange of mandrels for the next fabric. Thereafter, mandrel M can be removed and replaced by a mandrel needed for the next fabric to be run in line CL. Of course, ring 400 could have its own index motor and not be driven through a clutch operated by motor B.

As explained with respect to FIGS. 9 and 10, inward movement of mandrel M in a coordinated 1:1 relationship with the rotational speed or rate of mandrel M tends to cause the cords to be bunched in front of the mandrel as indicated in area m. This bunching action may be alleviated when the structure 100 is moved outwardly after a signal has been created in line 252 indicating the end of the cord capturing mode of operation. In accordance with another aspect of the present invention, the relationship between the rate of speed of motor B and rate of speed of motor A is preferably a relationship of about 1:0.6–0.9 and preferably about 1:2/3.

Figure 12:
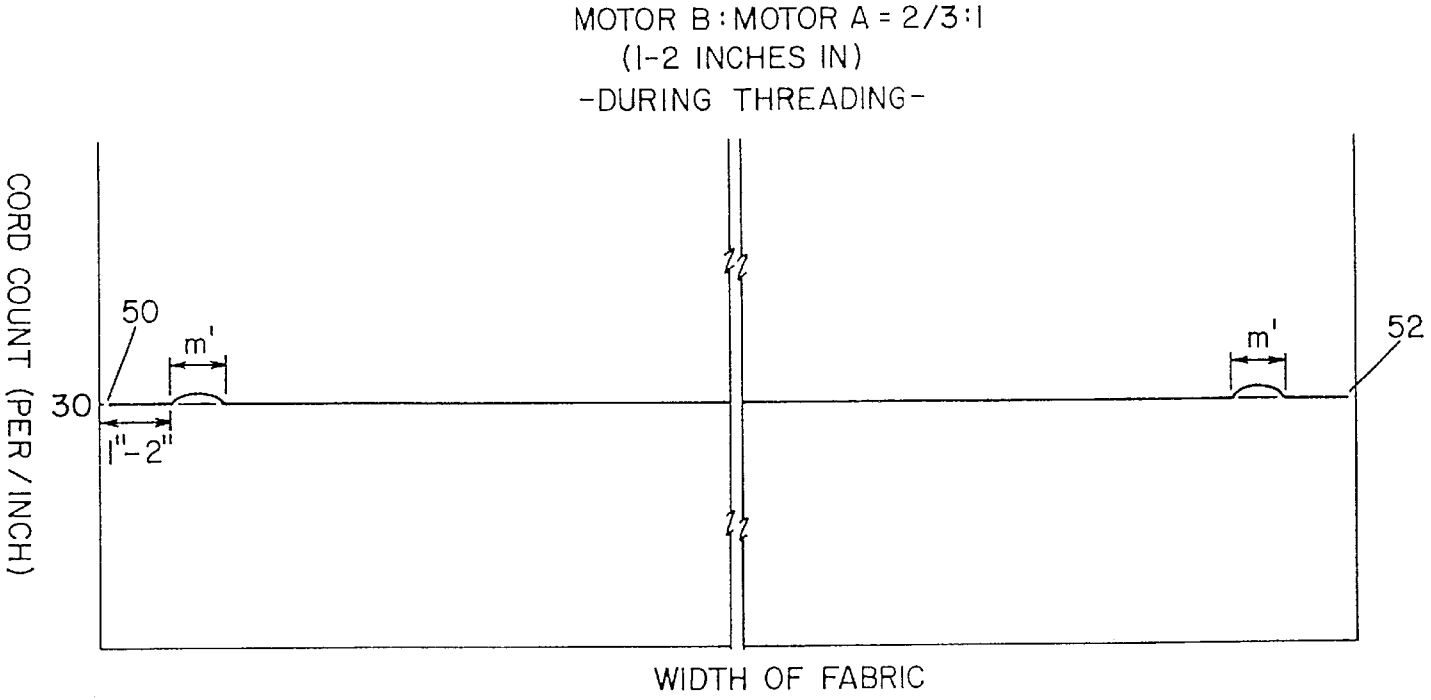
FIG. 12 is a graph similar to FIGS. 4 and 9 with the inward linear movement of the rotating mandrel during the capturing mode having a reduced rate of speed compared to the rate of the rotational speed whereby the cords are captured and pulled outwardly by the groove mandrel wherein the rotational rate of the mandrel is greater than the linear rate.
Figure 13:
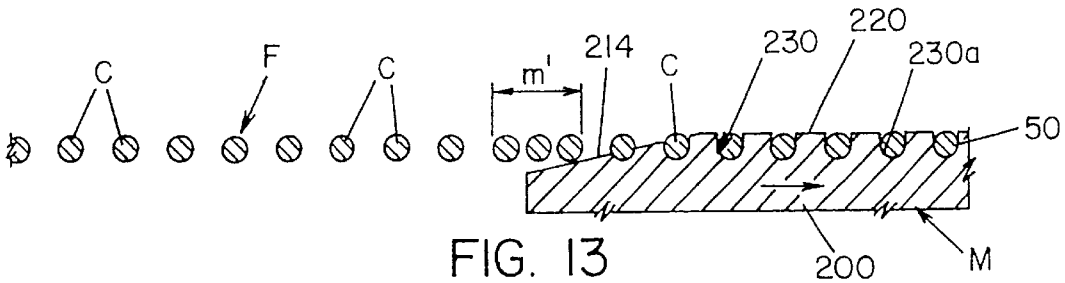
FIG. 13 is a view similar to FIG. 10 illustrating the operating characteristics of the preferred embodiment of the present invention as illustrated in the graph of FIG. 12, during the threading or capturing mode of operation.
Figure 14:
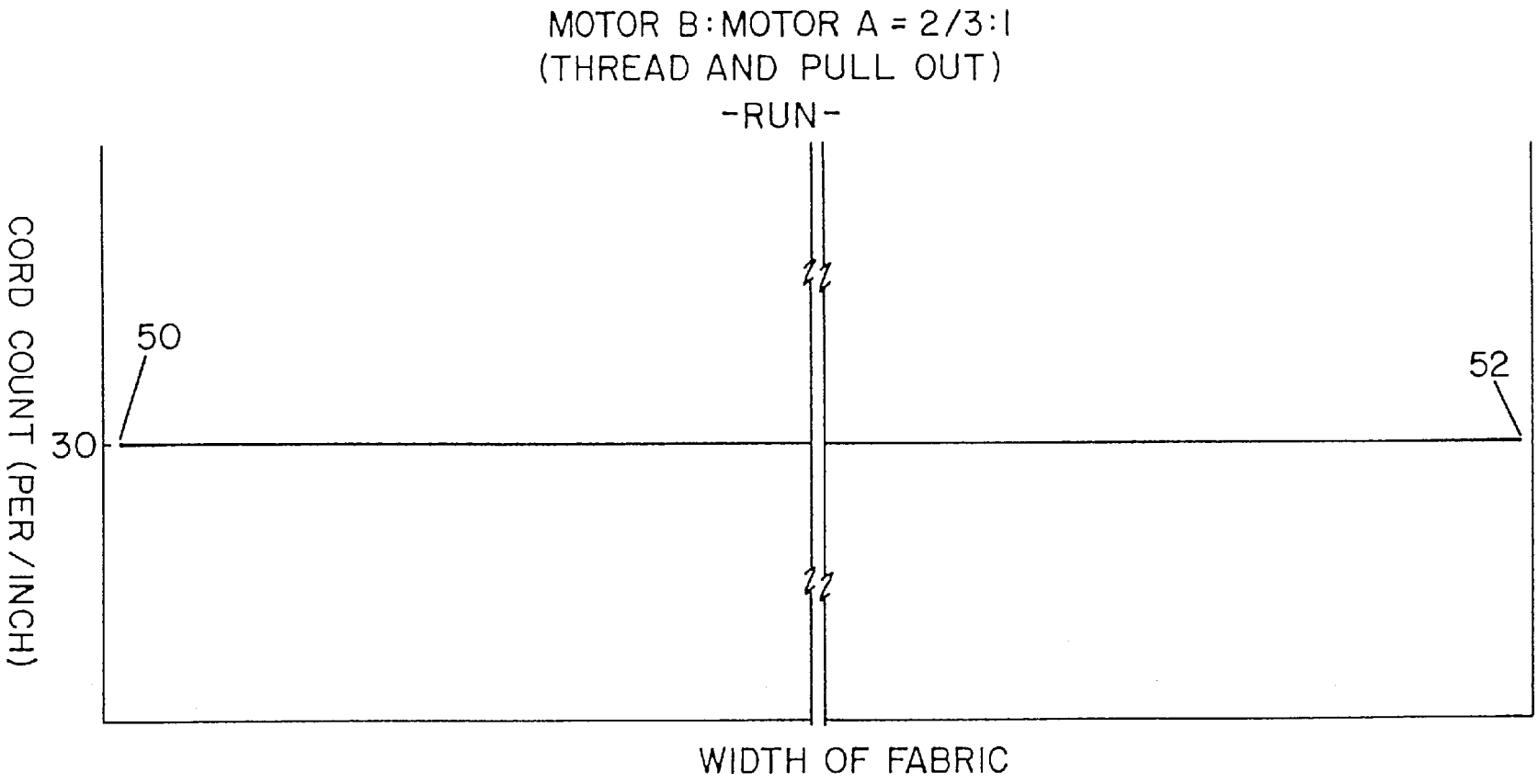
FIG. 14 is a graph similar to FIGS. 4, 10 and 12 showing the cord distribution across the width of the fabric during the steady state run mode of the present invention, where the invention is used for width control preparatory to the fabric entering the calender.

When this ratio of the rates of speed is maintained, the rate of rotation as it is compared to the cord distribution and the rate of forward movement of the mandrel is such that the cords are pulled onto the mandrel. Thus, the rate of rotational speed of motor A is at a first rate effectively advancing the groove outwardly one pitch P in a selected time. For example, if there are thirty cords per inch, each rotation of the mandrel moves the cords to the right 1/30 inches. Since rotational speed is in revolutions per time, this rotational movement is coordinated by time. In a like manner, the second rate of linear movement controlled by motor B advances the mandrel inwardly substantially less than one pitch P in the aforementioned "selected time". Thus, the rotation and linear motions pull the cords outwardly by the rotating groove. When this ratio is accomplished, there is small bunching, in front of the mandrel, if any. As illustrated in FIGS. 12 and 13, the small area of bunching m' that does occur is removed when mandrel support structure 100 moves mandrel M to the right. This results in the run condition shown schematically in FIG. 14 wherein the fabric F has a uniform cord distribution over its total width W. During the run operation, detector 250 controls the width W by controlling the position of edges 50, 52 through a system of the type shown generally in FIG. 5A.

Figure 15:
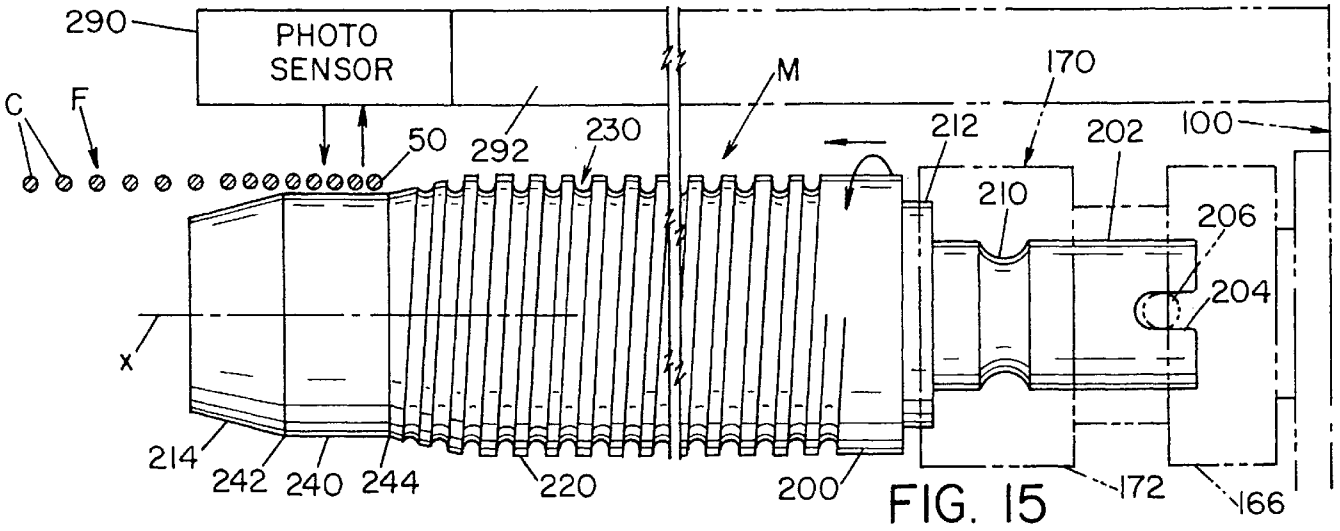
FIG. 15 is a side elevational view of a modified the grooved mandrel as it approaches the fabric in the capturing mode of operation, the mandrel has a smooth detection section positioned between the tapered end and the grooved portion of the mandrel and a photo electric detector spaced from the mandrel to detect the density of the cords on the detection section prior to the cords being captured in the groove portion.
Figure 16:
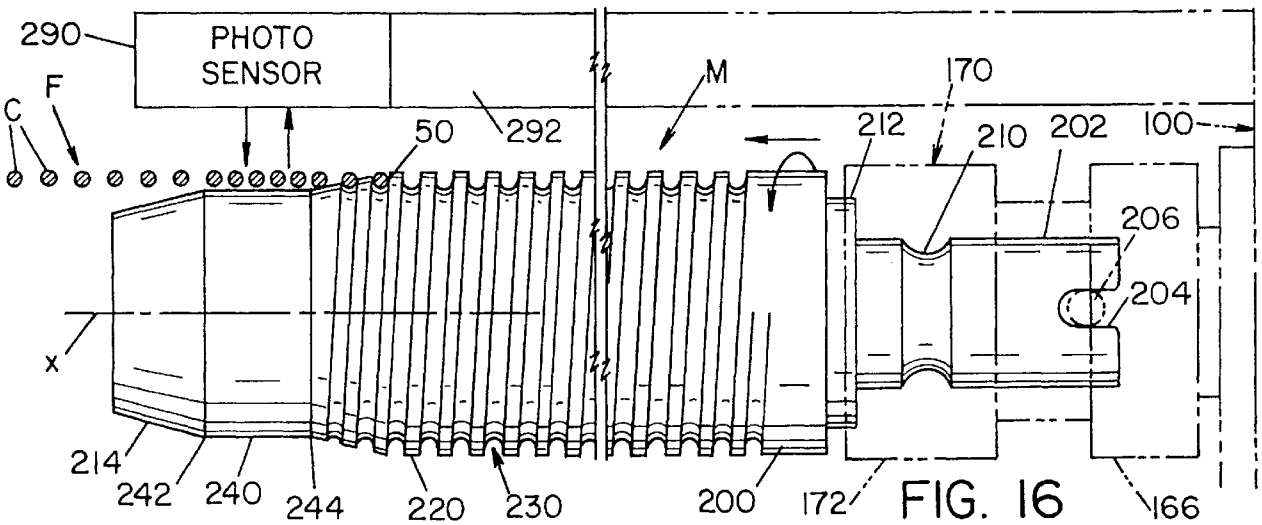
FIG. 16 is a side elevational view of the modified the grooved mandrel of FIG. 15 wherein the mandrel has captured several cords in the groove section of the mandrel during capture mode.

Referring now to FIGS. 15 and 16, there is illustrated a modification to mandrel M which was shown and described in FIG. 8. Mandrel M includes a detection surface 240 positioned between the end of outer cylindrical surface 220 and tapered nose 214. Detection surface 240 is a substantially smooth surface so that cords C of fabric F can easily pass or move along the detection surface 240. Detection surface 240 is used in conjunction with a density sensor 260. As shown in FIGS. 15 and 16, density sensor 260 is a photo sensor which is spaced at some distance above the surface of detection surface 240. Typically, the density sensor is spaced about 0.1–5 inches and preferably about 0.15–2 inches from the detection surface. Density sensor 260 is mounted to a sensor support 262 which in turn is mounted to support structure 100. As illustrated by the arrows in FIGS. 15 and 16, the photo sensor directs a light source downwardly toward detection surface 240. The light generated from photo sensor 260 contacts the fabric and/or the cords in the fabric. Some of the light is absorbed and/or reflected away by the fabric and cords. However, some light passes through the fabric, down on to the surface of the detection surface, reflected back upwardly from the detection surface, back through the cord and fabric and to a light detector in photo sensor 260 as illustrated in FIGS. 15 and 16. The amount of light detected by the photo sensor is a function of the density of cords C on detection surface 240. Therefore, the amount of light which passes through cords C and fabric F and is reflected upwardly from detection surface 240 and back through cords C and fabric F and be detected by the photo sensor is used to determine the density of cords C on detection surface 240. When there is a high density of cords C on detection surface 240, less light is detected by the photo sensor. When there is a lower density of cords C on detection surface 240, more light is detected by the photo sensor. Consequently, light intensity detected by the photo sensor can be correlated to determine the cord density on detection surface 240.

The surface of detection surface 240 is preferably smooth and reflective so as to minimize light scattering when light contacts the surface of the detection surface, and so as to reflect light back to the light sensor. The length of detection surface 240 is selected so that a sufficient number of cords can be positioned on the detection surface to obtain a desirably accurate density reading by the density sensor. The length of the detection surface is also selected so that a sufficient amount of light can be directed onto the detection surface. Typically, the length of the detection surface is about 0.1–2 inches, and preferably about 0.5–1 inch.

Figure 17:
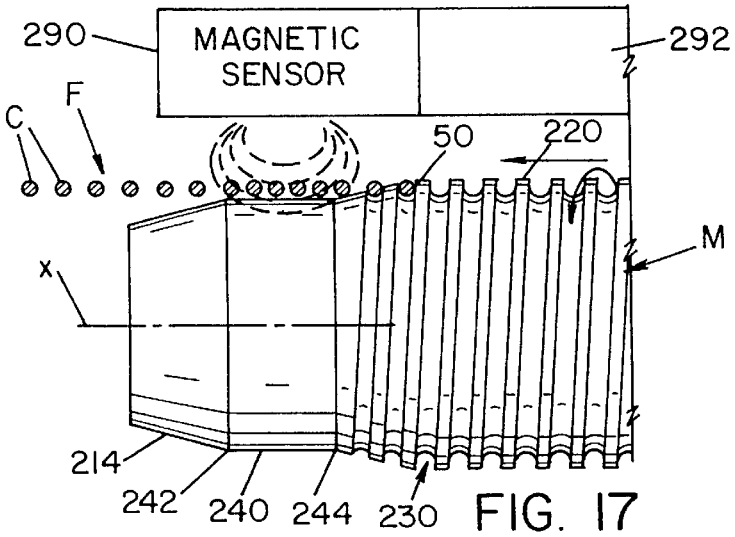
FIG. 17 is a partial elevational view of the modified the grooved mandrel of FIG. 15 wherein the detector is a magnetic sensor.
Figure 18:
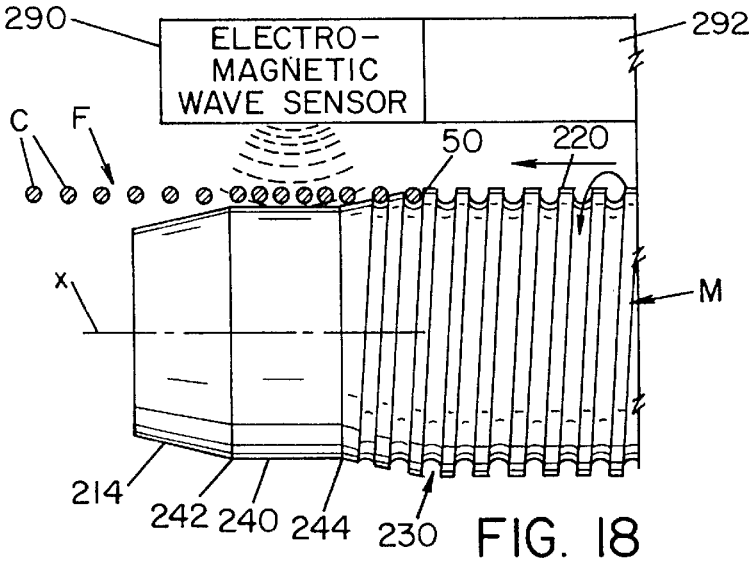
FIG. 18 is a partial elevational view of the modified the grooved mandrel of FIG. 15 wherein the detector is an electromagnetic wave sensor.
Figure 19:
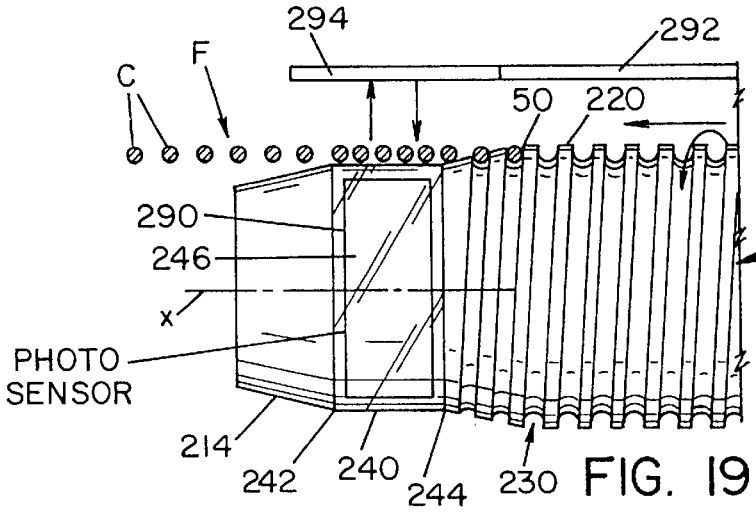
FIG. 19 is a partial elevational view of the modified the grooved mandrel of FIG. 15 wherein the photo electric detector in positioned in detection section of the mandrel.

FIGS. 17–19 illustrate several other arrangements to measure the cord density of the cords on detection surface 240. FIG. 17 illustrates density sensor 260 being a magnetic sensor which generates a magnetic wave toward detection surface 240. The detected fluxuation in the magnetic wave, which fluxuations are caused by the cord density on detection surface 240 is measured to determine the density of cords C on detection surface 240. FIG. 18 illustrates the density sensor 260 being an electromagnetic wave sensor. The electromagnetic wave sensor generates waves such as radio waves, inferred wave, ultraviolet waves, microwaves, or the like, toward detection surface 240. When the electromagnetic waves hit a cord in fabric F, the electromagnetic wave is deflected in a different direction and/or absorbed by cords C on detection surface 240. Therefore, the amount of electromagnetic waves detected from detection surface 240 is a function of the cord density on detection surface 240. FIG. 19 discloses the use of a photo sensor positioned inside of detection surface 240. The detection surface 240 includes a transparent plate 246 which allows light to pass through the plate and be reflected back from sensor reflector 264 which is spaced above detection surface 240. As can be appreciated, other types of density sensors can be used to detect the density of cords C on detection surface 240.

Figure 21:
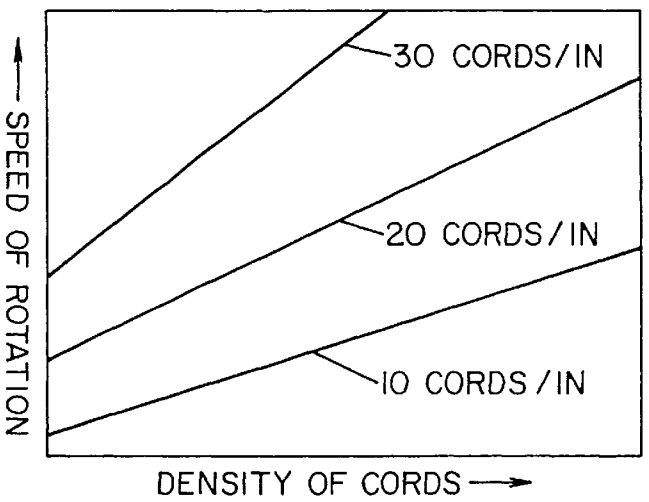
FIG. 21 is a graphical illustration the speed of rotation of the mandrel as a function of the density of the detected cords and of the type of fabric being spread.

The density of cords C detected by density sensor 260 is used to control the rotational speed of mandrel M. When the density of cords C is detected by density sensor 260 to be high, the rotational speed of the mandrel M is maintained or increased to ensure that a single cord C in fabric F is captured in a single groove 230. Alternatively, when density detector 260 determines that the density of cords C on detection surface 240 is low, the rotational speed of the mandrel M is maintained the same or reduced to ensure that each groove 230 in mandrel M captures a single cord C. Referring to FIG. 21, the correlation between the rotational speed of the mandrel M with respect to the detected density of the cords on detection surface 240 is shown for three different types of fabric. FIG. 21 illustrates that a specific density of cords C of fabric F corresponds to a desired mandrel rotation speed. As the cord density increases, the desired mandrel rotation speed increases. As the cord density decreases, the desired mandrel rotation speed decreases. FIG. 21, also illustrates that the mandrel rotation speed is a function of the type of fabric. As the number of cords in the fabric increases, a larger speed adjustment to the mandrel rotation speed occurs. FIG. 21, illustrates that the speed of rotation of the mandrel is a linear function to the density of the detected cords. As can be appreciated, the function can be nonlinear.

As can be appreciated, the lateral speed of support structure 100 can be made a function of the detected density of cord C on detection surface 240. In this control arrangement, the rotation speed of the mandrel M is maintained constant, and the speed in which support structure 110 moves mandrel M toward the center of fabric F increases or remains the same as when a high density of cords C is detected on detection surface 240 and is reduced or remains the same when a lower density of cords C is detected on detection surface 240. In another arrangement, both the rotation speed of the mandrel M and the lateral speed of support structure 110 are simultaneously controlled as a function of the detected cord density on detection surface 240.

Figure 22:
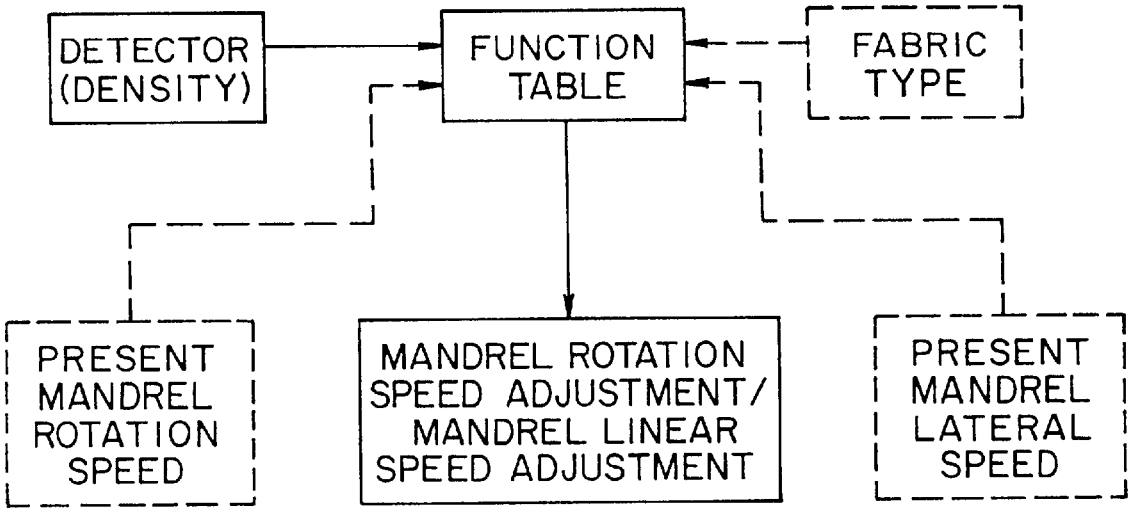
FIG. 22 is a block diagram illustrating the rotational control of the mandrel and/or the lateral speed of the mandrel as a function of one or more parameters.

Reference is now made to FIG. 22 which graphically illustrates a control structure for the mandrel M rotation speed and/or the lateral speed of the mandrel support 100. As shown in FIG. 22, the density of cords C detected by density sensor 260 on detection surface 240 sends its signal to a function table. One such function table is illustrated in FIG. 21. The function table converts the detected signal into a density value. The calculated value from the function table is then used to control the rotational speed of the mandrel and/or the lateral or linear speed of the mandrel support.

FIG. 22 also illustrates optional inputs which can be used to control the rotational speed of the mandrel and/or the lateral or linear speed of the mandrel support. These optional inputs are illustrated by dashed lines. One optional input is the type of fabric being spread. As illustrated in FIG. 21, the adjustment speed of rotation of the mandrel and/or lateral speed of the mandrel support can differ depending on the type of fabric being spread. Preferably, the fabric type being spread is a variable in controlling the rotational speed of the mandrel and/or the lateral or linear speed of the mandrel support.

Another optional input is the present mandrel rotation speed. When the rotation speed of mandrel M is to be controlled with respect to the detected density, it is desirable to know the actual or present mandrel rotation speed before adjusting the mandrel speed. Preferably, the actual or present mandrel rotation speed is compared to the calculated rotation speed of the mandrel determined by the function table If the function table determines that the rotation speed should be greater than the present rotation speed, the function table sends a signal to a controller which results in increased rotational speed of the mandrel. However, if the function table determines that the rotation speed of the mandrel should be less than the present rotation speed of the mandrel, the function table sends a signal to a controller which causes motor A to reduce the rotation speed of the mandrel. If the function table determines that the present rotational speed of the mandrel is the same as the calculated rotation speed of the mandrel, the function table will send a signal to motor A to maintain the present rotation speed of the mandrel.

Another optional input is the actual or present mandrel lateral or linear speed. When the lateral speed of support structure 100 is to be controlled as a function of the cord density, the actual or present lateral speed of the mandrel is preferably used to control the mandrel lateral speed. Preferably, the actual or present mandrel lateral speed is compared to the calculated lateral speed of the mandrel determined by the function table. If the function table determines that the lateral speed should be greater than the present lateral speed, the function table sends a signal to a controller which results in increased lateral speed of the mandrel. However, if the function table determines that the lateral speed of the mandrel should be less than the present lateral speed of the mandrel, the function table sends a signal to a controller which causes motor B to reduce the lateral speed of the mandrel. If the function table determines that the present lateral speed of the mandrel is the same as the calculated lateral speed of the mandrel, the function table will send a signal to motor B to maintain the present lateral speed of the mandrel.

In another arrangement, the function table is used to control both the mandrel rotation speed and the linear speed of the support structure 100. In this arrangement, a signal which indicates the present mandrel rotation speed and a signal which indicates the present lateral speed of support structure 100 is preferably used.

In the control arrangements wherein the mandrel rotation speed and/or the linear speed of the support structure is controlled during cord capture by the mandrel, the control arrangement preferably accounts for the time the cord density is detected and the time the detected cords are to be captured by the grooves in the mandrel. By accounting for this time delay, better accuracy is cord capture is achieved.

The values of the function table can be stored in microprocessor and/or formed into a control circuit. Preferably a microprocessor is used to control the mandrel rotation speed and/or the lateral speed of support structure 100. Furthermore, the valves of the function table are preferably programmable so that changes can be made and/or new values for other types of fabrics can be entered.

Figure 20:
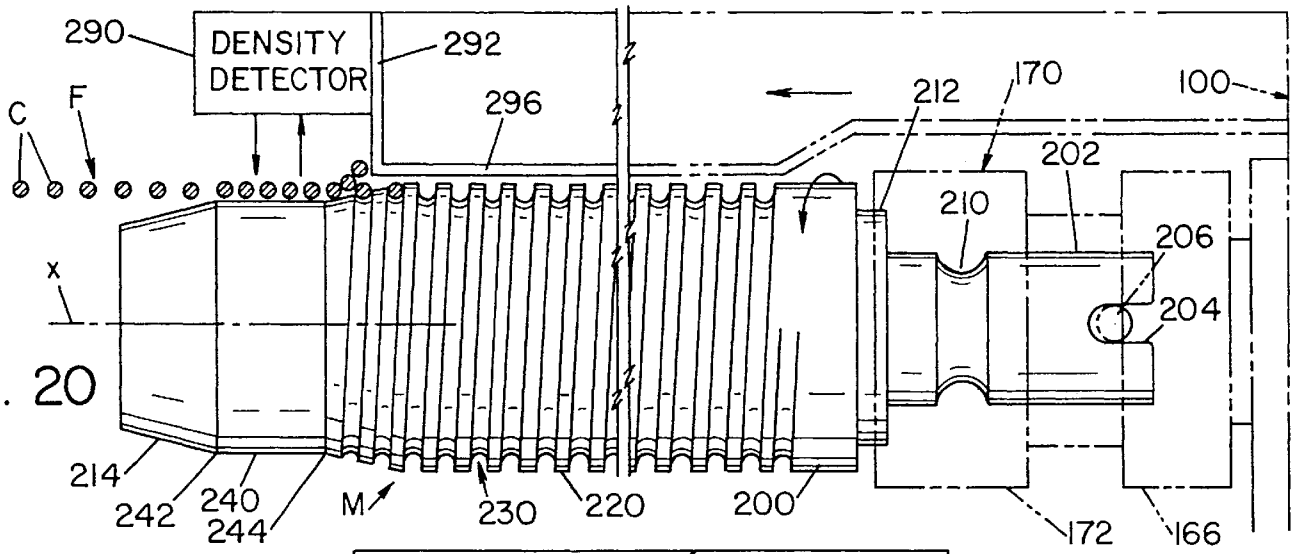
FIG. 20 is a side elevational view of the modified the grooved mandrel of FIG. 15 used in conduction with a cord rod that maintains the captured cords in the groove section of the mandrel.

Referring now to FIG. 20, a cord rod 270 is spaced above mandrel body portion 200 and is used to secure cord C in grooves 230 after they have been captured by mandrel M. Fabric F includes one or more picks per inch in the fabric to hold together the cords of the fabric. These picks run along the width of the fabric. Consequently, as these picks encounter the grooves, the picks have a tendency to lift cord C out of the grooves on mandrel M. Cord rod 270 is designed to retain the cords in the grooves to counter the adverse effects of the picks of the fabric. Preferably, cord rod 270 is spaced at a distance above mandrel body portion 200 which is less than the diameter of cord C. This spacing thereby prevents cord C from popping out of grooves 230. In addition, this spacing prevents one or more cord C from being captured within a groove 230 as shown in FIG. 20.

The invention has been described with reference to a preferred embodiment and alternates thereof. It is believed that many modifications, alterations to the embodiments disclosed will readily suggest themselves to those skilled in the art upon reading and understanding the detailed description of the invention. It is intended to include all such modifications and alterations insofar as they come within the scope of the present invention.

What is claimed is:

1. An elongated rotatable mandrel for spreading a fabric having upper and lower sides, transversely spaced edges and longitudinally extending reenforcing cords spaced laterally across said fabric between said edges preparatory to said fabric moving to a calender, said mandrel comprising a body portion, an end portion connected to the end of the body portion and a connector to connect said mandrel to a support structure adjacent at least one edge of said fabric, said body portion having an outer generally cylindrical surface concentric with a rotational axis, said cylindrical surface having a helical groove with convolutions having a pitch generally equal to a desired cord distribution laterally of said fabric, said end portion being a generally smooth surface.

2. The rotatable mandrel as defined in claim 1, wherein said end portion has a generally uniform cross-sectional area.

3. The rotatable mandrel as defined in claim 1, including a tapered portion connected to the end of said end portion.

4. The rotatable mandrel as defined in claim 2, including a tapered portion connected to the end of said end portion.

5. The rotatable mandrel as defined in claim 1, including at least a portion of a density sensor arrangement positioned on and/or in said end portion.

6. The rotatable mandrel as defined in claim 5, wherein said density sensor arrangement including a component selected from the group consisting of a light emitter, a light sensor, a contact sensor, and combinations thereof.

7. The rotatable mandrel as defined in claim 1, wherein said connector releasably connects said mandrel to said support structure.

8. The rotatable mandrel as defined in claim 4, wherein said connector releasably connects said mandrel to said support structure.

9. A method of spreading a fabric having upper and lower sides, transversely spaced edges and longitudinally extending cords spaced laterally across said fabric between said edges preparatory to treating said fabric as said fabric moves in a given path, said fabric having a desired transverse location for each of said edges, said method comprising the steps of:

(a) providing a mandrel having a body portion, said body portion having an outer generally cylindrical surface concentric with a rotational axis, said cylindrical surface having a helical groove with convolutions having a pitch generally equal to a desired cord distribution laterally of said fabric;

(b) rotatably mounting said mandrel on a support structure with said cylindrical surface aligned with said fabric path to be generally tangential to a side of said fabric as said fabric moves in said given path;

(c) providing a first motor for rotating said mandrel about said axis at a select rotational direction;

(d) providing a second motor for moving said support structure in a direction parallel to said rotational axis of said mandrel;

(e) moving said support structure until said body portion of said mandrel is aligned with a plurality of cords;

(f) moving said body portion of said mandrel into contact with a plurality of said cords;

(g) rotating said mandrel for a select period of time until a plurality of cords have been captured in said grooves.

10. The method as defined in claim 9, wherein said mandrel is rotated in one direction for a select period of time and said mandrel is then rotated in the opposite direction for a select period of time.

11. The method as defined in claim 9, wherein an edge detector positioned relative to said mandrel is activated after said select period of time has expired.

12. The method as defined in claim 10, wherein an edge detector positioned relative to said mandrel is activated after said select period of time has expired.

13. The method as defined in claim 9, including the step of:

(h) providing a density sensor to detect the density of said cords of said fabric on at least one portion of said mandrel; and (i) adjusting the rotational speed of said mandrel as a function of the density detected by said density sensor.

14. The method as defined in claim 12, including the step of:

(h) providing a density sensor to detect the density of said cords of said fabric on at least one portion of said mandrel; and (i) adjusting the rotational speed of said mandrel as a function of the density detected by said density sensor.

15. The method as defined in claim 14, wherein said rotation speed of said mandrel is adjusted based upon a parameter selected from the group consisting of cord density, mandrel groove pitch, mandrel type, fabric type, speed of fabric, cord diameter, sensor type, sensor spacing, rotation speed of said mandrel, and combinations thereof.

16. The method as defined in claim 15, including the step of:

(g) terminating the rotation of said mandrel as a function of said cord density when one edge of said fabric is detected by an edge sensor fixed with respect to said mandrel.

17. The method as defined in claim 9, include the step of:

(g) maintaining said captured cords in said grooves.

18. The method as defined in claim 16, include the step of:

(g) maintaining said captured cords in said grooves.

19. The method as defined in claim 17, wherein said step of maintaining includes the positioning of a cord rod at least partially along the axis length of said mandrel, said cord rod being spaced from the surface of said mandrel.

20. The method as defined in claim 18, wherein said step of maintaining includes the positioning of a cord rod at least partially along the axis length of said mandrel, said cord rod being spaced from the surface of said mandrel.

21. The method as defined in claim 18, where said at least a portion of said density sensor is mounted on said cord rod.

22. The method as defined in claim 9, wherein said mandrel support frame includes a turret rotatable about an axis generally parallel with said axis of said mandrel and having a first connector to connect said mandrel to said turret, a second connector to connect a second mandrel to said turret and an selection mechanism to move said mandrel between a first position with said mandrel in the operative position tangential to said fabric and a second position with said second mandrel in said operative position.

23. The method as defined in claim 21, wherein said mandrel support frame includes a turret rotatable about an axis generally parallel with said axis of said mandrel and having a first connector to connect said mandrel to said turret, a second connector to connect a second mandrel to said turret and an selection mechanism to move said mandrel between a first position with said mandrel in the operative position tangential to said fabric and a second position with said second mandrel in said operative position.

* * * * *